US009012778B2

(12) United States Patent
Nordin et al.

(10) Patent No.: US 9,012,778 B2
(45) **Date of Patent: *Apr. 21, 2015**

(54) COMMUNICATION CABLE WITH IMPROVED ELECTRICAL CHARACTERISTICS

(71) Applicant: Panduit Corp., Tinley Park, IL (US)

(72) Inventors: Ronald A. Nordin, Naperville, IL (US); Masud Bolouri-Saransar, Orland Park, IL (US); Timothy J. Houghton, II, Chicago, IL (US); Steven C. Weirather, Atlanta, GA (US); Hector J. Hoffmaister, Curridabat (CR)

(73) Assignee: Panduit Corp., Tinley Park, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/897,776

(22) Filed: May 20, 2013

(65) Prior Publication Data

US 2013/0277090 A1 Oct. 24, 2013

Related U.S. Application Data

(63) Continuation of application No. 12/773,551, filed on May 4, 2010, now Pat. No. 8,445,787.

(60) Provisional application No. 61/175,968, filed on May 6, 2009, provisional application No. 61/229,640, filed on Jul. 29, 2009.

(51) Int. Cl.

| | |
|---|---|
| ***H01B 7/00*** | (2006.01) |
| ***H01B 11/08*** | (2006.01) |
| ***H01B 11/10*** | (2006.01) |

(52) U.S. Cl.
CPC ..... *H01B 11/085* (2013.01); *H01B 11/1008* (2013.01)

(58) Field of Classification Search
USPC ..... 174/36, 108, 109, 110 R, 113 R, 120 R, 174/120 SP, 115, 116, 112
See application file for complete search history.

(56) References Cited

U.S. PATENT DOCUMENTS

| | | | | |
|---|---|---|---|---|
| 2,796,463 | A * | 6/1957 | Mallinckrodt | 178/45 |
| 3,312,774 | A * | 4/1967 | Drinko et al. | 174/120 SC |
| 3,794,750 | A * | 2/1974 | Garshick | 174/36 |
| 4,129,841 | A * | 12/1978 | Hildebrand et al. | 333/237 |
| 4,236,779 | A * | 12/1980 | Tang | 439/607.48 |
| 4,743,336 | A * | 5/1988 | White | 156/522 |
| 4,743,725 | A | 5/1988 | Risman | |
| 5,473,336 | A | 12/1995 | Harman et al. | |
| 7,332,676 | B2 * | 2/2008 | Sparrowhawk | 174/102 R |
| 7,923,641 | B2 * | 4/2011 | Smith et al. | 174/113 R |

(Continued)

FOREIGN PATENT DOCUMENTS

| | | |
|---|---|---|
| CN | 201197261 Y | 2/2009 |
| JP | 58-131518 U | 9/1983 |

(Continued)

*Primary Examiner* — William H Mayo, III
(74) *Attorney, Agent, or Firm* — Christopher S. Clancy; Christopher K. Marlow

(57) ABSTRACT

A communication cable with a plurality of twisted pairs of conductors and a matrix tape having conductive segments separated by gaps. In some embodiments, an insulating layer is placed between the twisted pairs of conductors and the matrix tape. In some embodiments, the insulating layer is an embossed or perforated film.

14 Claims, 40 Drawing Sheets

(56) References Cited

U.S. PATENT DOCUMENTS

| | | | | |
|---|---|---|---|---|
| 8,183,462 | B2 | 5/2012 | Nordin et al. | |
| 2006/0048961 | A1* | 3/2006 | Pfeiler et al. | 174/36 |
| 2007/0044996 | A1* | 3/2007 | Clark | 174/113 R |
| 2009/0173511 | A1* | 7/2009 | Smith et al. | 174/36 |

FOREIGN PATENT DOCUMENTS

| | | | |
|---|---|---|---|
| JP | S63171912 | U | 11/1988 |
| JP | 2006-073534 | A | 3/2006 |
| WO | 2008157175 | A1 | 12/2008 |
| WO | 2009111689 | A1 | 9/2009 |

* cited by examiner

Common Mode Pair-2-Pair Coupling

Differential Mode Current Direction on Wires.

Common Mode Current Direction on Wire-Pairs.

Differential Mode Voltage within Wire-Pair.

Common Mode Voltage on Wire-Pairs.

2300

| Keep Out Modes = 2L/n | | | | |
|---|---|---|---|---|
| order | 1st | 2nd | 3rd | 4th |
| even | 2 | 4 | 6 | 8 |
| odd | 3 | 5 | 7 | 9 |

2302

COMMUNICATION CABLE WITH IMPROVED ELECTRICAL CHARACTERISTICS

CROSS-REFERENCE TO RELATED APPLICATIONS

This application is a continuation of U.S. application Ser. No. 12/773,551, filed May 4, 2010; which claims priority to U.S. Application Ser. No. 61/175,968, filed May 6, 2009; and U.S. Provisional Application Ser. No. 61/229,640 filed Jul. 29, 2009, the subject matters of which are hereby incorporated by reference in their entireties.

FIELD

The present invention relates to communication cables, and more particularly, to methods and apparatus to improve the electrical characteristics of such cables.

BACKGROUND

As networks become more complex and have a need for higher bandwidth cabling, the ability to meet prescribed electrical specifications, such as those relating to cable-to-cable crosstalk ("alien crosstalk"), near-end crosstalk (NEXT) between wire pairs within a cable, and data signal attenuation, becomes increasingly important to provide a robust and reliable communication system.

Many vendors of communication cables utilize air gaps or spacing between cables to meet performance requirements. Another solution involves the use of a matrix tape wrapped around the wire pairs of an unshielded twisted pair (UTP) cable. U.S. patent application Ser. No. 12/399,331, titled "Communication Cable with Improved Crosstalk Attenuation"; and also International Publication No. WO 2008/157175, titled "Communication Channels With Crosstalk-Mitigating Material", assigned to Panduit Corp., describe such a solution and are hereby incorporated by reference herein in their entirety. The matrix tape solution has succeeded in attenuating crosstalk; however, improvement of additional electrical characteristics, such as reduced data signal attenuation, controlled alien crosstalk resonance, electromagnetic compatibility (EMC), and/or avoidance of coherent differential mode coupling between cables, is desirable.

BRIEF DESCRIPTION OF THE DRAWINGS

For the purpose of facilitating an understanding of the invention, the accompanying drawings and description illustrate embodiments thereof, from which the inventions, structure, construction and operation, and many related advantages may be readily understood and appreciated.

DETAILED DESCRIPTION OF PREFERRED EMBODIMENTS

Figure 1:
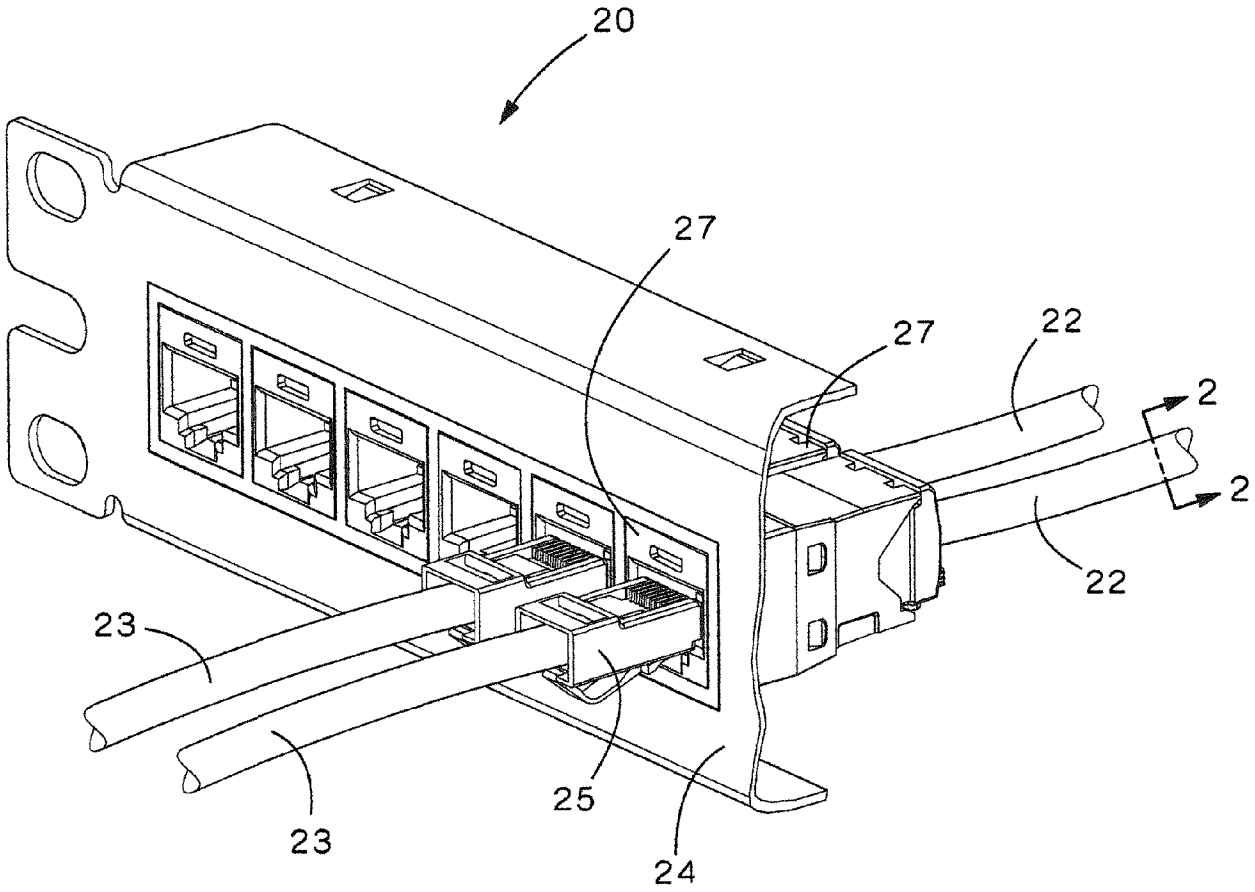
FIG. 1 is a schematic view of an embodiment of a communication system including multiple communication cables according to the present invention.

Referring now to the drawings, and more particularly to FIG. 1, there is shown a communication system 20, which includes at least one communication cable 22, 23 connected to equipment 24. Equipment 24 is illustrated as a patch panel in FIG. 1, but the equipment can be passive equipment or active equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers/telecommunications rooms; security devices (cameras and other sensors, etc.) and door access equipment; and telephones, computers, fax machines, printers and other peripherals as can be found in workstation areas. Communication system 20 can further include cabinets, racks, cable management and overhead routing systems, for example.

Communication cable 22, 23 can be in the form of an unshielded twisted pair (UTP) horizontal cable 22 and/or as a patch cable 23, and more particularly a Category 6A cable which can operate at 500 MHz and 10 Gb/s, as is shown more particularly in FIG. 2, and which is described in more detail below. However, the present invention can be applied to and/or implemented in a variety of communications cables, as have already been described, as well as other types of cables. Cables 22, 23 can be terminated directly into equipment 24, or alternatively, can be terminated in a variety of plugs 25 or jack modules 27 (such as RJ45 type), jack module cassettes, Infiniband connectors, RJ21, and many other connector types, or combinations thereof. Further, cables 22, 23 can be processed into looms, or bundles, of cables, and additionally can be processed into preterminated looms.

Communication cable 22, 23 can be used in a variety of structured cabling applications including patch cords, zone cords, backbone cabling, and horizontal cabling, although the present invention is not limited to such applications. In general, the present invention can be used in military, industrial, residential, telecommunications, computer, data communications, and other cabling applications.

Figure 2:
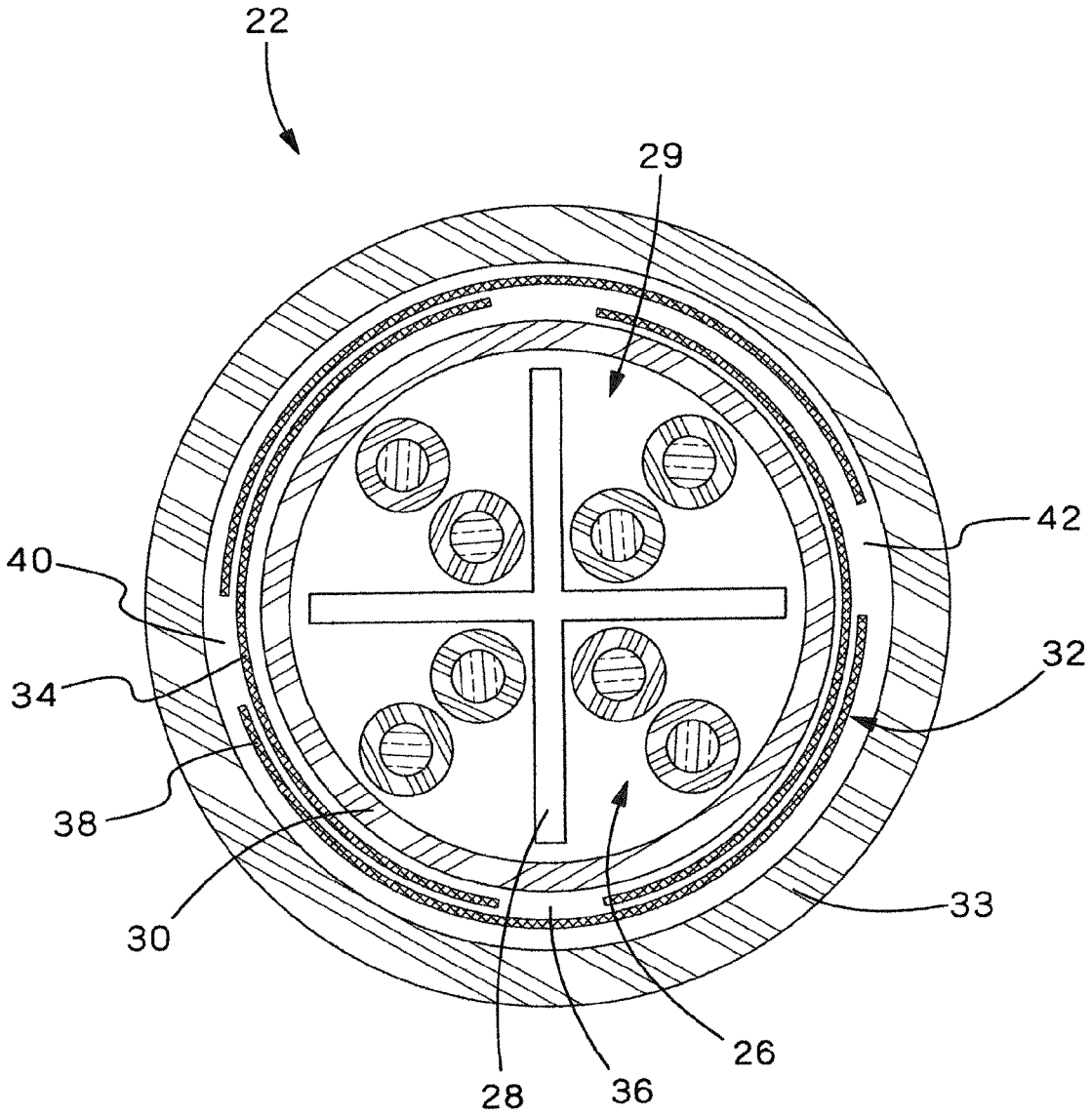
FIG. 2 is a cross-sectional view of one of the communication cables taken along section line 2-2 of FIG. 1.

Referring more particularly to FIG. 2, there is shown a transverse cross-section of cable 22, 23. Cable 22, 23 includes an inner core 29 of four twisted conductive wire pairs 26 that are typically separated with a crossweb 28. An inner insulating layer 30 (e.g., a plastic insulating tape or an extruded insulating layer, for example a 10 mil thick inner insulating jacket material) surrounds the conductive wire pairs 26 and cross web 28. A wrapping of matrix tape 32 (also known as "barrier tape") surrounds the inner insulating layer 30. Matrix tape 32 can be helically wound around the insulating layer 30. Cable 22, 23 also can include an outer insulating jacket 33. The matrix tape 32 is shown in a condensed version for simplicity in FIG. 2, illustrating only an insulating substrate 42 and conductive segments 34 and 38.

Figure 3:
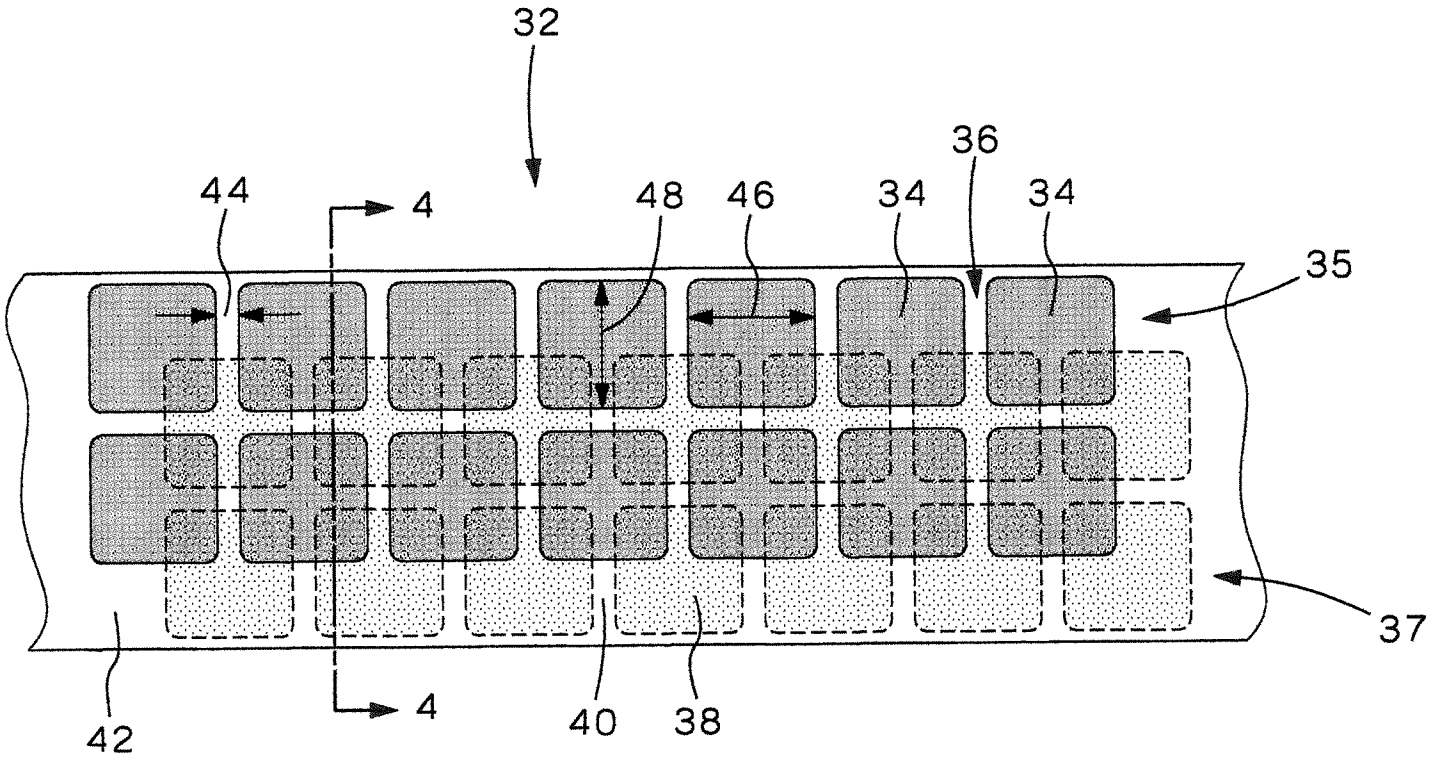
FIG. 3 is a fragmentary plan view of an embodiment of a matrix tape according to the present invention and used in the cables of FIGS. 1 and 2.
Figure 4:
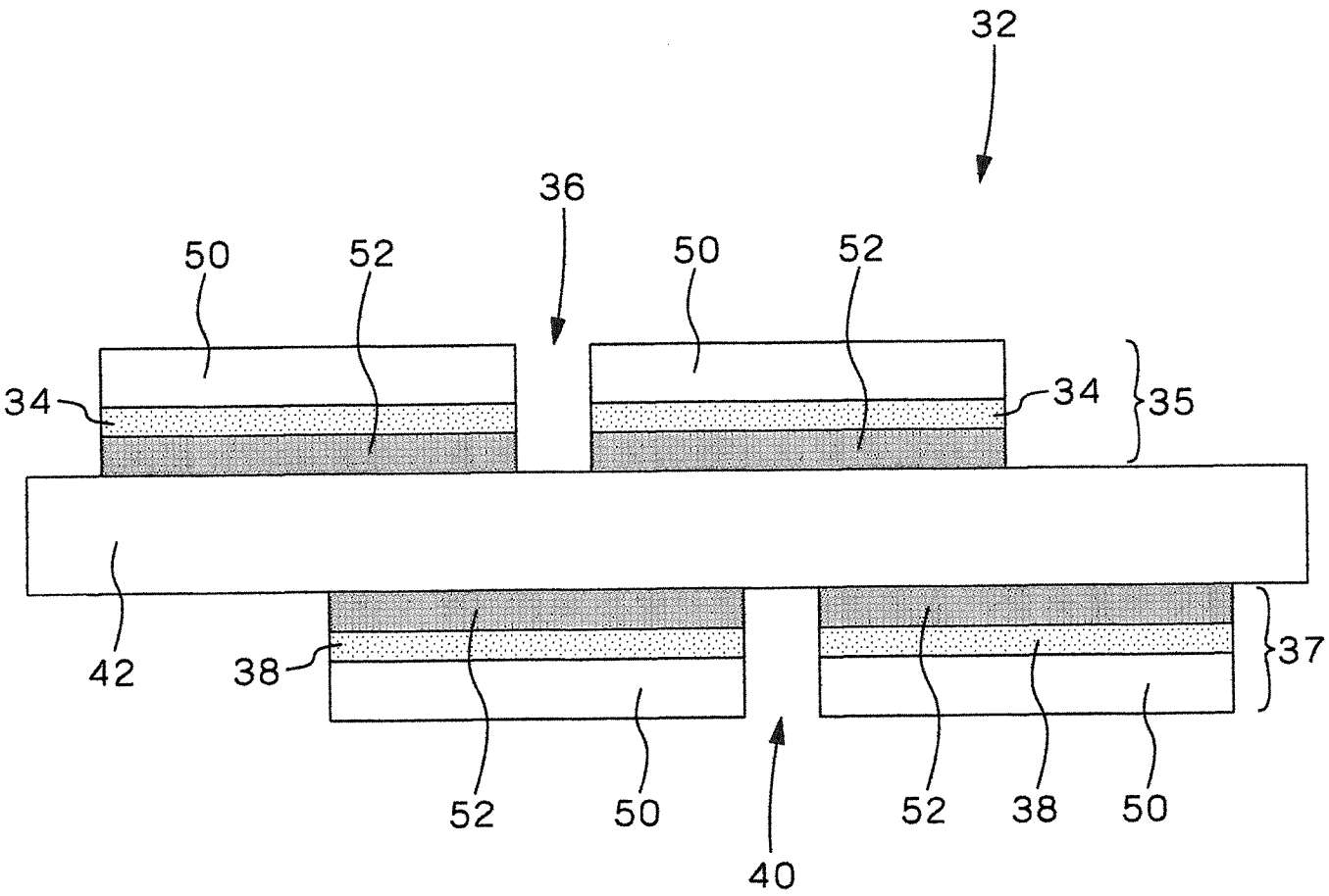
FIG. 4 is a cross-sectional view of the matrix tape of FIG. 3, taken along section 4-4 in FIG. 3.

Referring also to FIGS. 3 and 4, and as is discussed in more detail below, matrix tape 32 includes a first barrier layer 35 (shown in FIG. 2 as an inner barrier layer) comprising conductive segments 34 separated by gaps 36; a second barrier layer 37 (shown in FIG. 2 as an outer barrier layer) comprising conductive segments 38 separated by gaps 40 in the conductive material of segments 38; and an insulating substrate 42 separating conductive segments 34 and gaps 36 of the first conductive layer from conductive segments 38 and gaps 40 of the second conductive layer. The first and second barrier layers, and more particularly conductive segments 34 and conductive segments 38, are staggered within the cable so that gaps 40 of the outer barrier layer align with the conductive segments 34 of the inner conductive layer. Matrix tape 32 can be helically or spirally wound around the inner insulating layer 30. Alternatively, the matrix tape can be applied around the insulative layer in a non-helical way (e.g., cigarette or longitudinal style).

Outer insulating jacket 33 can be 15-16 mil thick (however, other thicknesses are possible). The overall diameter of cable 22 can be under 300 mils, for example; however, other thicknesses are possible, such as in the range of 270-305 mils, or other thicknesses.

FIG. 3 is a plan view of matrix tape 32 illustrating the patterned conductive segments on an insulative substrate where two barrier layers 35 and 37 of discontinuous conductive material are used. The conductive segments 34 and 38 are arranged as a mosaic in a series of plane figures along both the longitudinal and transverse direction of an underlying substrate 42. As described, the use of multiple barrier layers of patterned conductive segments facilitates enhanced attenuation of alien crosstalk, by effectively reducing coupling by a cable 22, 23 to an adjacent cable, and by providing a barrier to coupling from other cables. The discontinuous nature of the conductive segments 34 and 38 reduces or eliminates radiation from the barrier layers 35 and 37. In the embodiment shown, a double-layered grid-like metal pattern is incorporated in matrix tape 32, which spirally wraps around the twisted wire pairs 26 of the exemplary high performance 10 Gb/s cable. The pattern may be chosen such that conductive segments of a barrier layer overlap gaps 36, 40 from the neighboring barrier layer. In FIGS. 3 and 4, for example, both the top 35 and bottom 37 barrier layers have conductive segments that are arranged in a series of squares (with rounded corners) approximately 330 mil×330 mil with a 60 mil gap size 44 between squares. According to one embodiment, the rounded corners are provided with a radius of approximately 1/32".

Referring to the inner barrier layer 35, the performance of any single layer of conductive material is dependent on the gap size 44 of the discontinuous pattern and the longitudinal length 46 of the discontinuous segments and can also be at least somewhat dependent on the transverse widths 48 of the conductive segments. In general, the smaller the gap size 44 and longer the longitudinal length 46, the better the cable-to-cable crosstalk attenuation will be. However, if the longitudinal pattern length 46 is too long, the layers of discontinuous conductive material will radiate and be susceptible to electromagnetic energy in the frequency range of relevance. One solution is to design the longitudinal pattern length 46 so it is slightly greater than the longest pair lay of the twisted conductive wire pairs within the surrounded cable but smaller than one quarter of the wavelength of the highest frequency signal transmitted over the wire pairs. The pair lay is equal to the length of one complete twist of a twisted wire pair.

Typical twist lengths (i.e., pair lays) for high-performance cable (e.g., 10 Gb/s) are in the range of 0.8 cm to 1.3 cm. Hence the conductive segment lengths are typically within the range of from approximately 1.3 cm to approximately 10 cm for cables adapted for use at a frequency of 500 MHz. At higher or lower frequencies, the lengths will vary lower or higher, respectively.

Further, for a signal having a frequency of 500 MHz, the wavelength will be approximately 40 cm when the velocity of propagation is 20 cm/ns. At this wavelength, the lengths of the conductive segments of the barrier layers should be less than 10 cm (i.e., one quarter of a wavelength) to prevent the conductive segments from radiating or being susceptible to electromagnetic energy.

It is also desirable that the transverse widths 48 of the conductive segments "cover" the twisted wire pairs as they twist in the cable core. In other words, it is desirable for the transverse widths 48 of the conductive segments to be wide enough to overlie a twisted pair in a radial direction outwardly from the center of the cable. Generally, the wider the transverse widths 48, the better the cable-to-cable crosstalk attenuation is. It is further desirable for the matrix tape 32 to be helically wrapped around the cable core at approximately the same rate as the twist rate of the cable's core. For high-performance cable (e.g., 10 Gb/s), typical cable strand lays (i.e., the twist rate of the cable's core) are in the range of from approximately 6 cm to approximately 12 cm. It is preferred that matrix tapes according to the present invention are wrapped at the same rate as the cable strand lay (that is, one complete wrap in the range of from approximately 6 cm to approximately 12 cm). However, the present invention is not limited to this range of wrap lengths, and longer or shorter wrap lengths may be used.

A high-performing application of a matrix tape of discontinuous conductive segments is to use one or more conductive barrier layers to increase the cable-to-cable crosstalk attenuation. For barriers of multiple layers, barrier layers are separated by a substrate so that the layers are not in direct electrical contact with one another. Although two barrier layers 35 and 37 are illustrated, the present invention can include a single barrier layer, or three or more barrier layers.

FIG. 4 illustrates a cross-sectional view of matrix tape 32 in more detail as employed with two barrier layers 35 and 37. Each barrier layer includes a substrate 50 and conductive segments 34 or 38. The substrate 50 is an insulative material and can be approximately 0.7 mils thick, for example. The layer of conductive segments contains plane figures, for example squares with rounded corners, of aluminum having a thickness of approximately 0.35 mils. According to other embodiments of the present invention, the conductive segments may be made of different shapes such as regular or irregular polygons, other irregular shapes, curved closed shapes, isolated regions formed by conductive material cracks, and/or combinations of the above. Other conductive materials, such as copper, gold, or nickel may be used for the conductive segments. Semiconductive materials may be used in those areas as well. Examples of the material of the insulative substrate include polyester, polypropylene, polyethylene, polyimide, and other materials.

The conductive segments 34 and 38 are attached to a common insulative substrate 42 via layers of spray glue 52. The layers of spray glue 52 can be 0.5 mils thick and the common layer of insulative substrate 42 can be 1.5 mil thick, for example. Given the illustrated example thicknesses for the layers, the overall thickness of the matrix tape 32 of FIG. 4 is approximately 4.6 mils. It is to be understood that different material thicknesses may be employed for the different layers. According to some embodiments, it is desirable to keep the distance between the two layers of conductive segments 34 and 38 large so as to reduce capacitance between those layers.

When using multiple layers of discontinuous conductive material as barrier material the gap coverage between layers assists in decreasing cable-to-cable crosstalk. This may be best understood by examining the capacitive and inductive coupling between cables.

Figure 5:
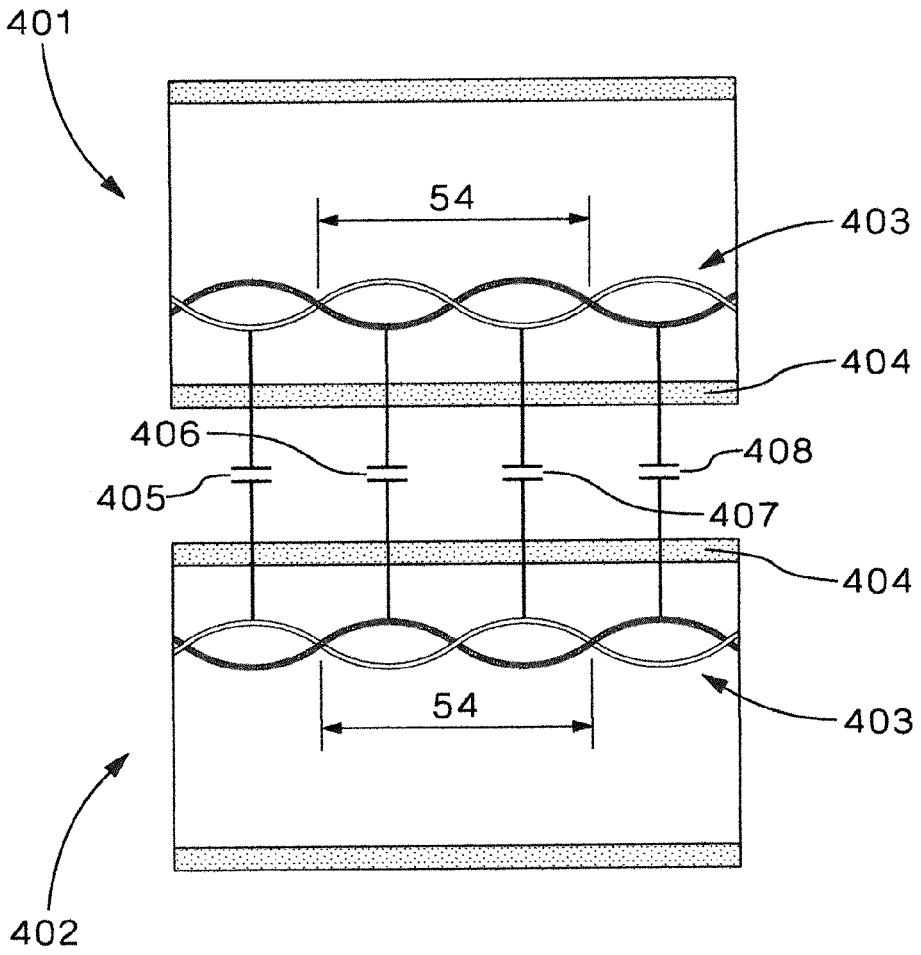
FIG.5 (prior art)
FIG. 5 is a longitudinal cross-sectional view of the parasitic capacitive modeling of two prior art cables.

FIG. 5 illustrates a model of parasitic capacitive coupling of two prior art cables 401 and 402. Here, the two cables 401 and 402 employ insulating jackets 404 as a method of attenuating cable-to-cable crosstalk between the two twisted pairs of wire 403 of standard 10 Gb/s Ethernet twist length 54 (pair lay). The resultant parasitic capacitive coupling, as illustrated by modeled capacitors 405-408, creates significant cable-to-cable crosstalk. Although capacitors 405-408 are shown as lumped capacitive elements for the purpose of the FIG. 5 model, they are in fact a distributed capacitance.

Figure 6:
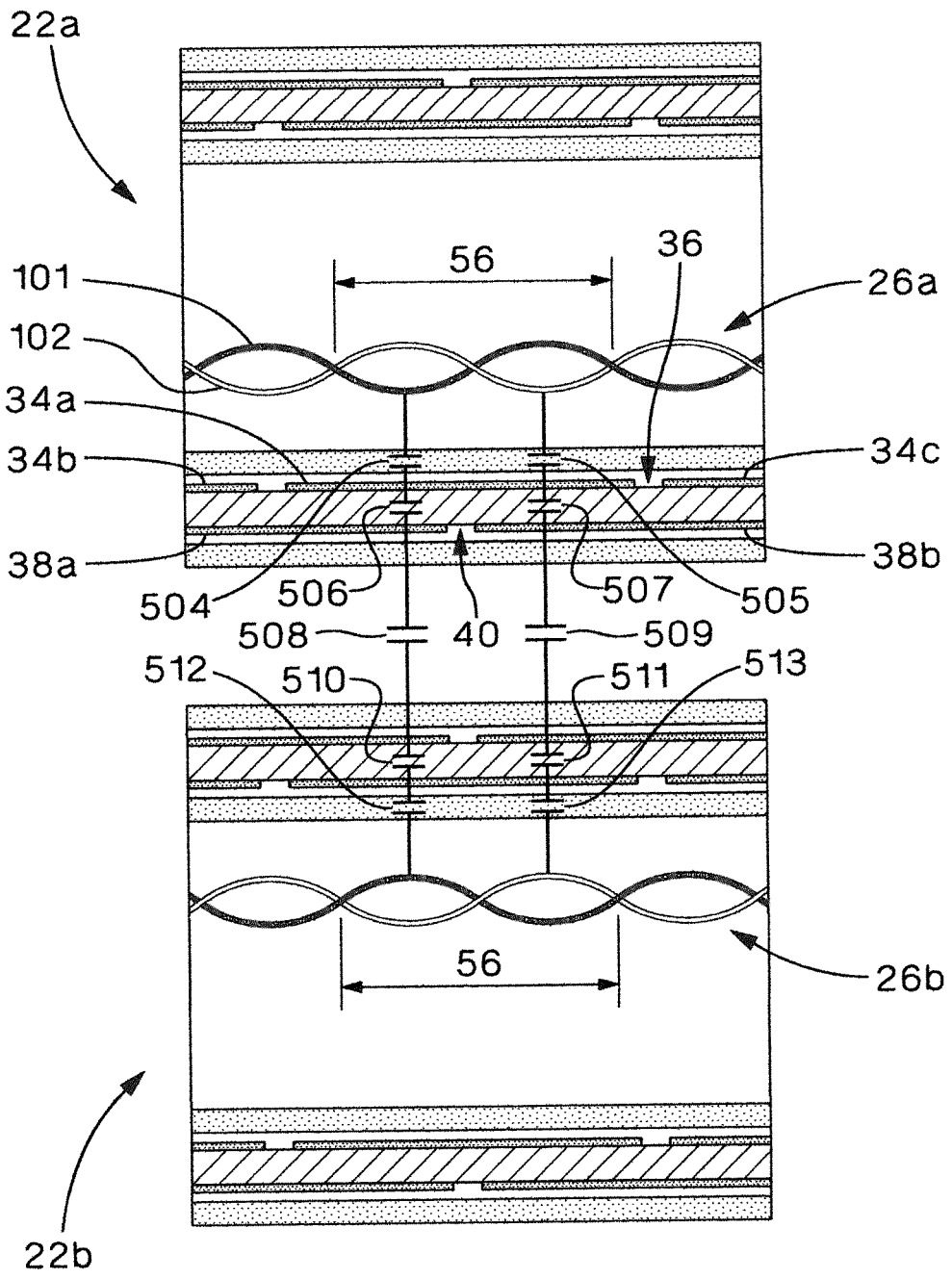
FIG. 6 is a longitudinal cross-sectional view of the parasitic capacitive modeling of two cables according to an embodiment of the present invention.

In contrast, FIG. 6 illustrates the parasitic capacitive coupling of two cables **22*a* and 22*b* using the barrier technique of the present invention. Though the overall effect results from a distributed capacitance, lumped element capacitor models are shown for the purpose of illustrating the distributed parasitic capacitive coupling. First and second twisted wires 101 and 102 of the twisted pair 26*a* carry a differential signal, and can be modeled as having opposite polarities. The "positive" polarity signal carried by the first wire 101 and the "negative" polarity signal carried by the second wire 102 couple approximately equally to the conductive segment 34***a*. This coupling is modeled by the capacitors 504 and 505. As a result, very little net charge is capacitively coupled from the twisted pair 26 onto the conductive segment 34*a*, resulting in a negligible potential. What little charge is coupled onto the conductive segment 34*a* is further distributed by coupling onto the conductive segments 38*a* and 38*b* in the outer barrier layer of the cable 22*a* via modeled capacitors 506 and 507. Because the conductive segments 38*a* and 38*b* are also capacitively coupled with additional inner conductive segments 34*b* and 34*c*, the amount of capacitive coupling is further mitigated due to cancellation effects resulting from the opposite polarities of the twisted wires 101 and 102. Similar cancellation effects carry through the additional modeled capacitors 508-513, so that the overall capacitive coupling between the twisted pair 26*a* of the first cable 22*a* and the twisted pair 26*b* of the second cable 22*b* is substantially decreased as compared to a prior art system. The spacing of the gaps 36 and 40 in the two barrier layers of a matrix tape greatly reduces the opportunity for direct cable-to-cable capacitive coupling.

Figure 7:
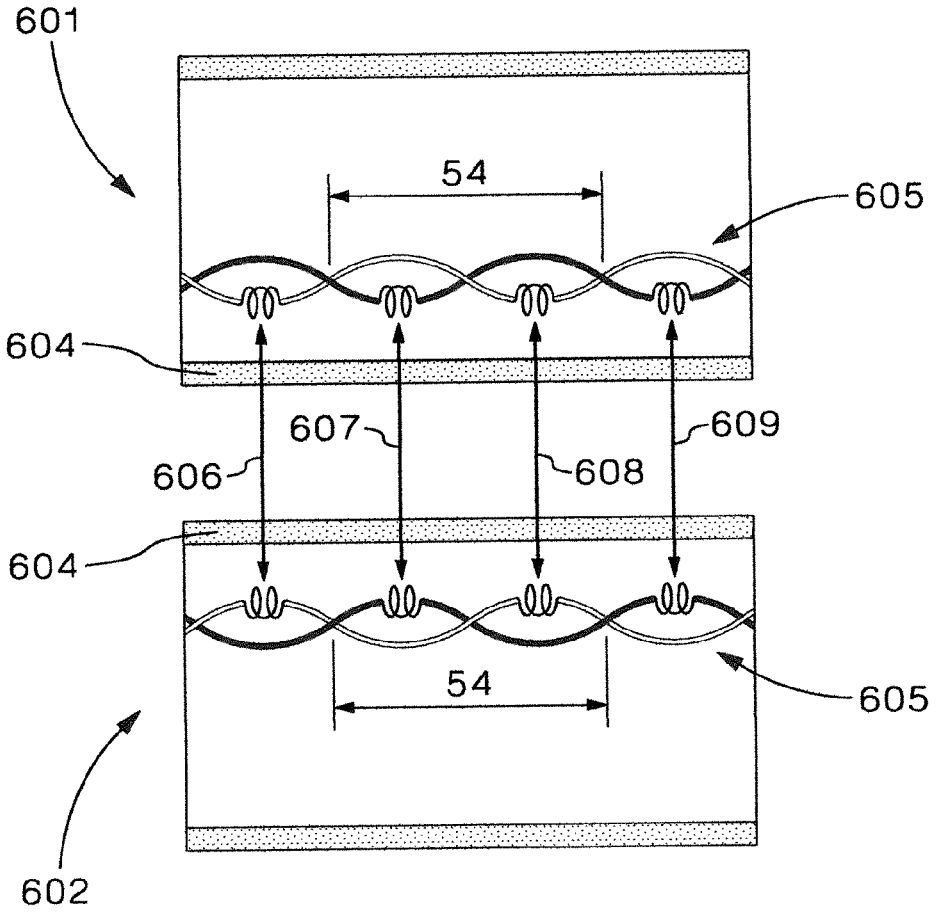
FIG.7 (prior art)
FIG. 7 is a longitudinal cross-sectional view of a parasitic inductive modeling of two prior art cables.
Figure 8:
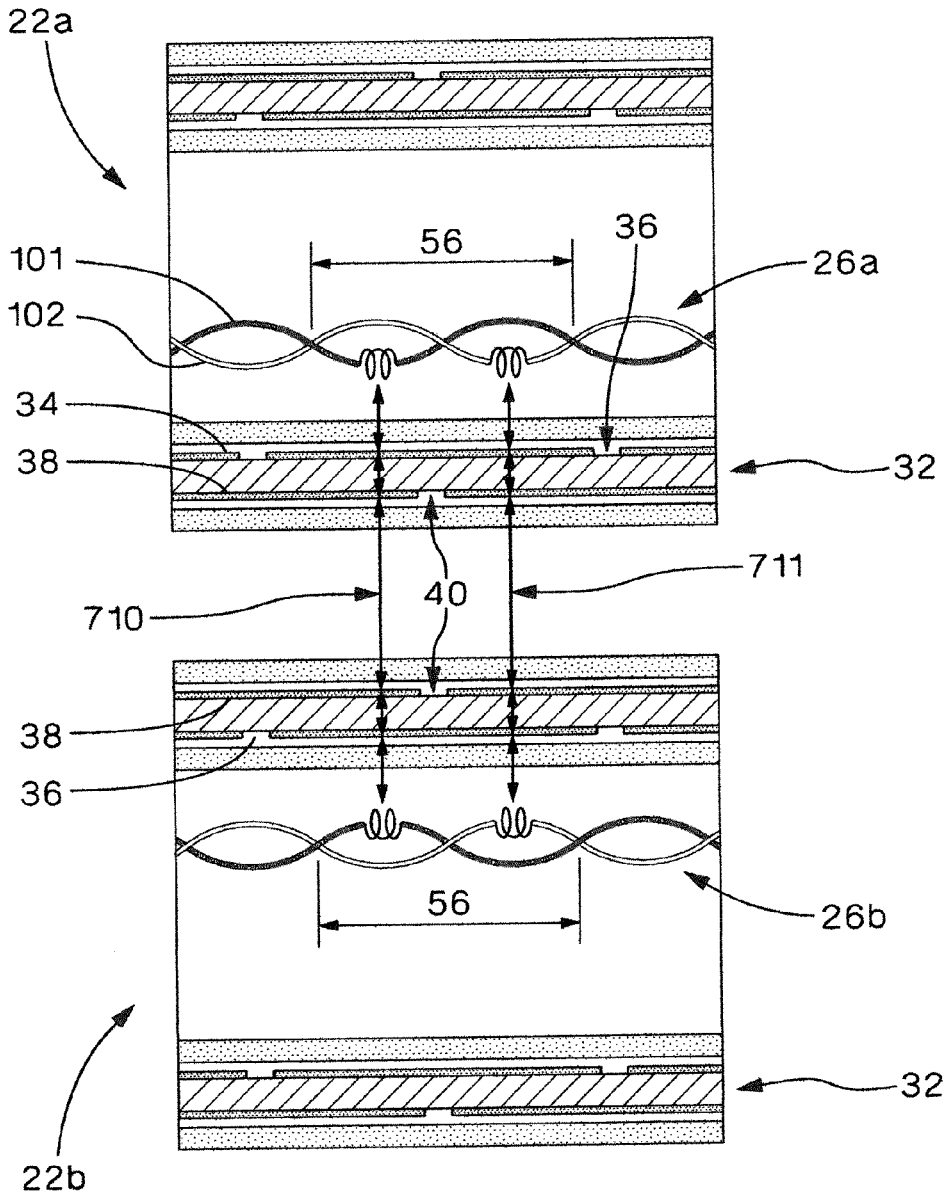
FIG. 8 is a longitudinal cross-sectional view of a parasitic inductive modeling of two cables according to an embodiment of the present invention.

Turning to inductive modeling, FIG. 7 illustrates the parasitic distributed inductive modeling of two prior art cables. In FIGS. 7 and 8, currents in the conductors produce magnetic fields and the distributed inductance of the conductors results in inductive coupling shown by the arrows. For purposes of illustration, specific regions of the magnetic fields are indicated by arrows, but the magnetic fields are actually distributed throughout the illustrated areas. Here, both cables 601 and 602 employ only insulating jackets 604 as a method of attenuating cable-to-cable crosstalk between the two twisted pairs of wire 605 of standard 10 Gb/s Ethernet twist length 54 (pair lay). The resultant parasitic inductive coupling modeled at 606-609 creates significant cable-to-cable crosstalk.

FIG. 8 illustrates inductive modeling of two cables using the barrier techniques as proposed by the present invention. The two twisted wires of cables 22*a* and 22*b* respectively contain twisted pairs 26*a* and 26*b* and same standard 10 Gb/s Ethernet twist length 56 (pair lay), as the prior art model. However, the two cables 22*a* and 22*b* are protected with matrix tape 32. The barrier layers 35 and 37 contain respective gaps 36 and 40 in the conductive material to prevent the conductive material segments 34 and 38 from radiating. The conductive segments are staggered within the cable so that most gaps in the conductive material are aligned with conductive segments of the adjacent layer.

Magnetic fields are induced in the first cable 22*a* by the twisted wire pair 26*a*. However, as the magnetic fields pass through the inner barrier layer of the matrix tape 32, they create eddy currents in the conductive segments, reducing the extent of magnetic coupling 710 and 711, and reducing cable-to-cable crosstalk. However, the need for gaps 36 and 40 in the barrier layers 35 and 37 results in some portions of the magnetic fields passing near a boundary or gap. Eddy currents are not as strongly induced near a boundary or gap, resulting in less reduction of the passing magnetic field in these regions.

One solution again is to use multiple barrier layers 35 and 37 so that a gap from one layer is covered by conductive material from the adjacent layer. The second cable 22*b* illustrates an outer barrier layer (particularly conductive segment 38) covering a gap 36 in the inner conductive layer 35. As discussed above, the magnetic fields passing through the conductive layer 35 and 37 do not lose much energy because eddy currents are not as strongly induced near boundaries or gaps 36 and 40. However, by ensuring that a gap 36 in the inner conductive layer 35 is covered by a conductive segment from the outer barrier layer, the magnetic fields passing through the inner barrier layer create stronger eddy currents while passing through the outer barrier layer, therefore reducing their energy and reducing cable-to-cable crosstalk. Therefore, it is desirable to arrange the gaps 36 and 40 of the barrier layers to be aligned with conductive segments from an adjacent barrier layer; however, some gaps in the barrier layers may remain uncovered without significantly affecting the cable-to-cable crosstalk attenuation of the present invention.

Figure 9:
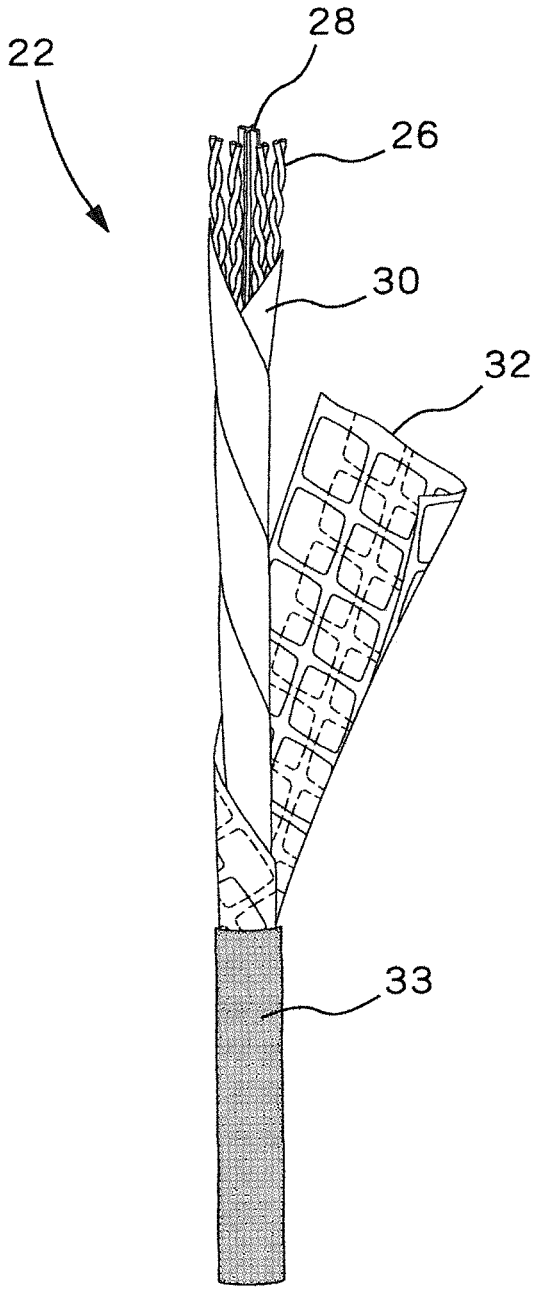
FIG. 9 is a perspective view of an embodiment of the cable of FIG. 1, illustrating the spiral nature of the installation of the matrix tape within the cable.

FIG. 9 illustrates how the matrix tape 32 is spirally wound between the insulating layer 30 and the outer jacket 33 of the cable 22. Alternatively, the matrix tape can be applied around the insulative layer in a non-helical way (e.g., cigarette or longitudinal style). It is desirable for the helical wrapping of the matrix tape 32 to have a wrap rate approximately equal to the core lay length of the cable 22 (i.e., the rate at which the twisted pairs 26 of the cable wrap around each other). However, in some embodiments the helical wrapping of the matrix tape 32 may have a wrap rate greater or less than the core lay length of the cable 22.

Figure 10:
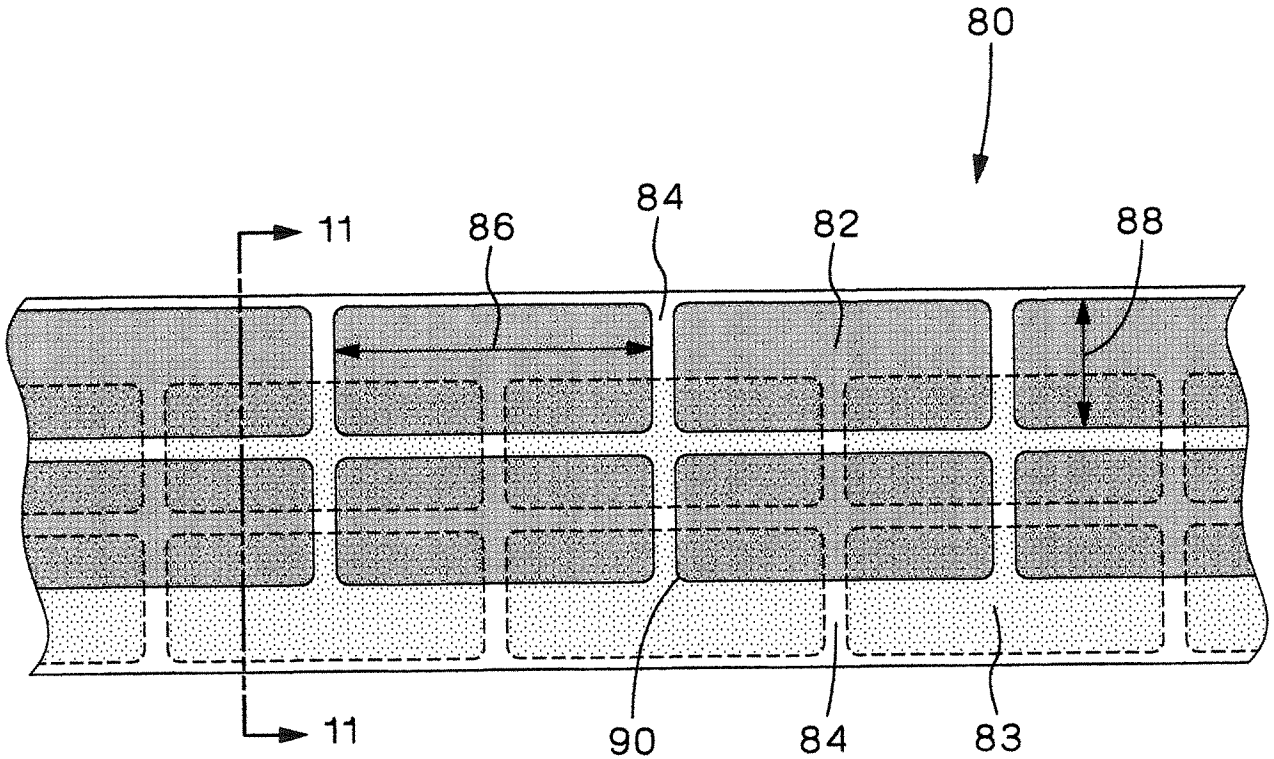
FIG. 10 is a fragmentary plan view of another embodiment of a matrix tape according to the present invention.

FIG. 10 illustrates another embodiment of a matrix tape 80 according to the present invention. The matrix tape 80 is similar to the matrix tape 32 shown and described above, except that the matrix tape 80 is provided with upper and lower rectangular conductive segments 82 and 83. The rectangular segments on each layer are separated by gaps 84. The rectangular conductive segments 82 and 83 have a longitudinal length 86 and a transverse width 88. According to one embodiment, the longitudinal length 86 of each rectangular conductive segment 82 is approximately 822 mils, and the transverse width 88 is approximately 332 mils. In this embodiment, the gaps 84 are approximately 60 mils wide. As the conductive segment shape and size can be varied, so can the gap width. For example, the gap can be 55 mils or other widths. In general, the higher the ratio of the longitudinal lengths of the conductive segments to the gap widths, the better the crosstalk attenuation. Different dimensions may be provided, however, depending on the desired performance characteristics of the cable. The rectangular conductive segments 82 are provided with rounded corners 90, and in the illustrated embodiment the rounded corners 90 have a radius of approximately 1/32".

It is desirable for conductive segments according to the present invention to be provided with curved corners in order to reduce the chances of undesirable field effects that could arise if sharper corners are used. According to some embodiments of the present invention, curved corners having radii in the range of 10 mils to about 500 mils are preferable, though larger or smaller radii may be beneficial in certain embodiments.

Figure 11:
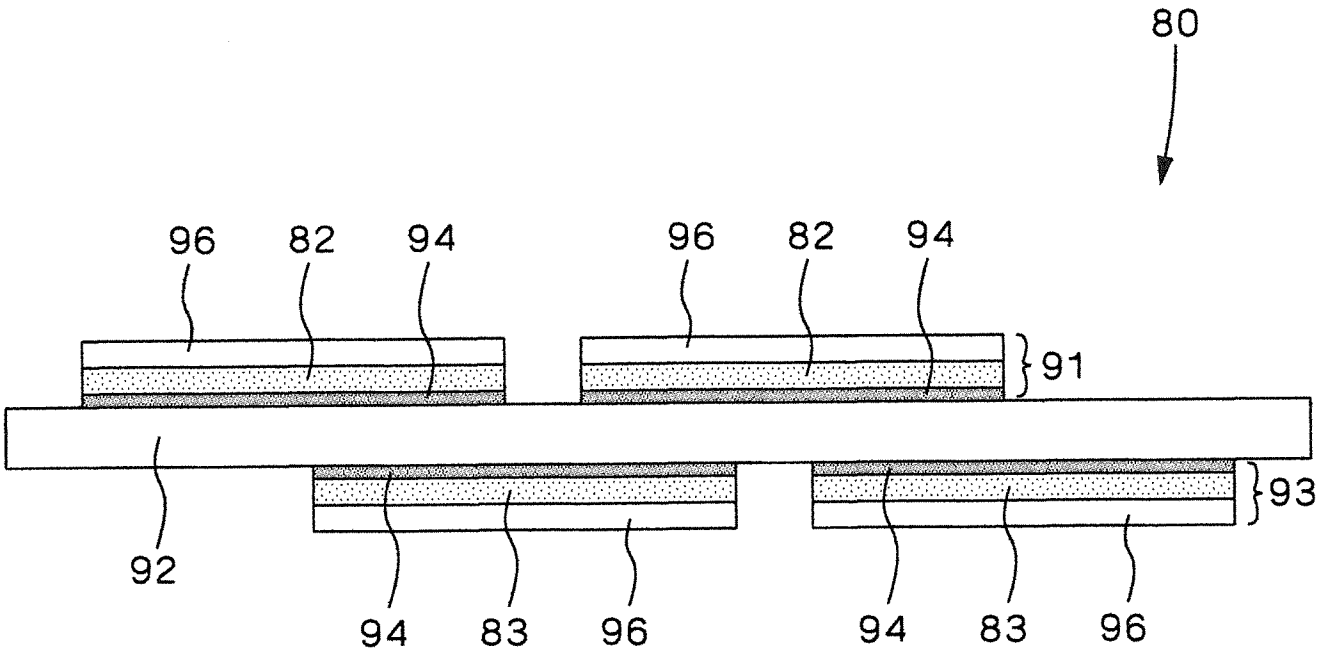
FIG. 11 is a cross-sectional view of the matrix tape of FIG. 10 taken along the line 11-11 of FIG. 10.

FIG. 11 is a cross-sectional view of the matrix tape 80 taken along the line 11-11 of FIG. 10. The matrix tape 80 comprises an insulative substrate 92 and upper and lower barrier layers 91 and 93 having rectangular conductive segments 82 and 83. The rectangular conductive segments 82 and 83 are attached to the substrate 92 by a layer of spray glue 94 and are bordered by outer substrate layers 96. According to one embodiment, the insulative substrate 92 has a thickness of about 1.5 mils, the spray glue layers 94 have thicknesses of approximately 0.5 mils, the conductive segments 82 and 83 have thicknesses of about 1 mil, and the outer substrate layers 96 have thicknesses of about 1 mil. Other thicknesses may be used for the layers depending on the desired physical and performance qualities of the matrix tape 80.

Internal Near-End Crosstalk Reduction in a Cable Utilizing Matrix Tape

Much of the above discussion has focused exclusively on alien cable-to-cable crosstalk. Another electrical characteristic to be considered in a cable design is near-end crosstalk (NEXT) between wire pairs, also known as internal NEXT. The design of the barrier between the wire pairs and matrix tape, as well as the pattern design of the matrix tape itself can be chosen to reduce internal NEXT. The following discussion describes several possible design choices that may be utilized to reduce such NEXT, while still maintaining significant alien crosstalk attenuation between cables.

Internal NEXT is typically controlled by two parameters: (1) the twist lay of each pair and (2) the distance between two pairs (which is generally kept small to minimize the cable diameter). When matrix tape (such as matrix tape 26) is introduced in a cable, an additional crosstalk mechanism is introduced. This mechanism is the capacitive coupling between two wire pairs through the matrix tape. The controlling parameters for this coupling are (1) the distance between the wire pairs and the matrix tape and (2) the metallic pattern on the matrix tape itself.

The distance between the wire pairs and the matrix tape controls the amount of capacitive coupling a wire pair has to the matrix tape. Since the inner insulating layer (e.g. inner insulating layer 30 in FIG. 2) makes up a significant portion of this distance, the characteristic impedance (or return loss) of a pair has a component that is controlled by the inner insulating layer separation and dielectric constant of the inner insulating layer. A preferred material to use as the barrier is foamed polypropylene or polyethylene because they provide a dielectric constant of about 1.7. With such a material, a inner insulating layer thickness of 10 mils provides an adequate separation distance. More generally, a preferred distance (mils) to dielectric constant ratio (ddr) for the inner insulating layer is greater than around 5.88 (i.e. ddr>≈5.88). Higher ratios will assist in further reducing internal crosstalk.

In addition to the distance between the wire pairs and the matrix tape, another parameter for controlling capacitive coupling between two wire pairs through the matrix tape is the design of the matrix tape itself. FIGS. 12-16 illustrate different matrix tape designs control capacitive coupling differently. In the following discussion, the conductive segments are referred to as "bricks". This for convenience only, and is not intended to imply that the conductive segments need to be brick-shaped. As previously stated, many different shapes may be used without departing from the scope of embodiments of the present invention.

Figure 12:
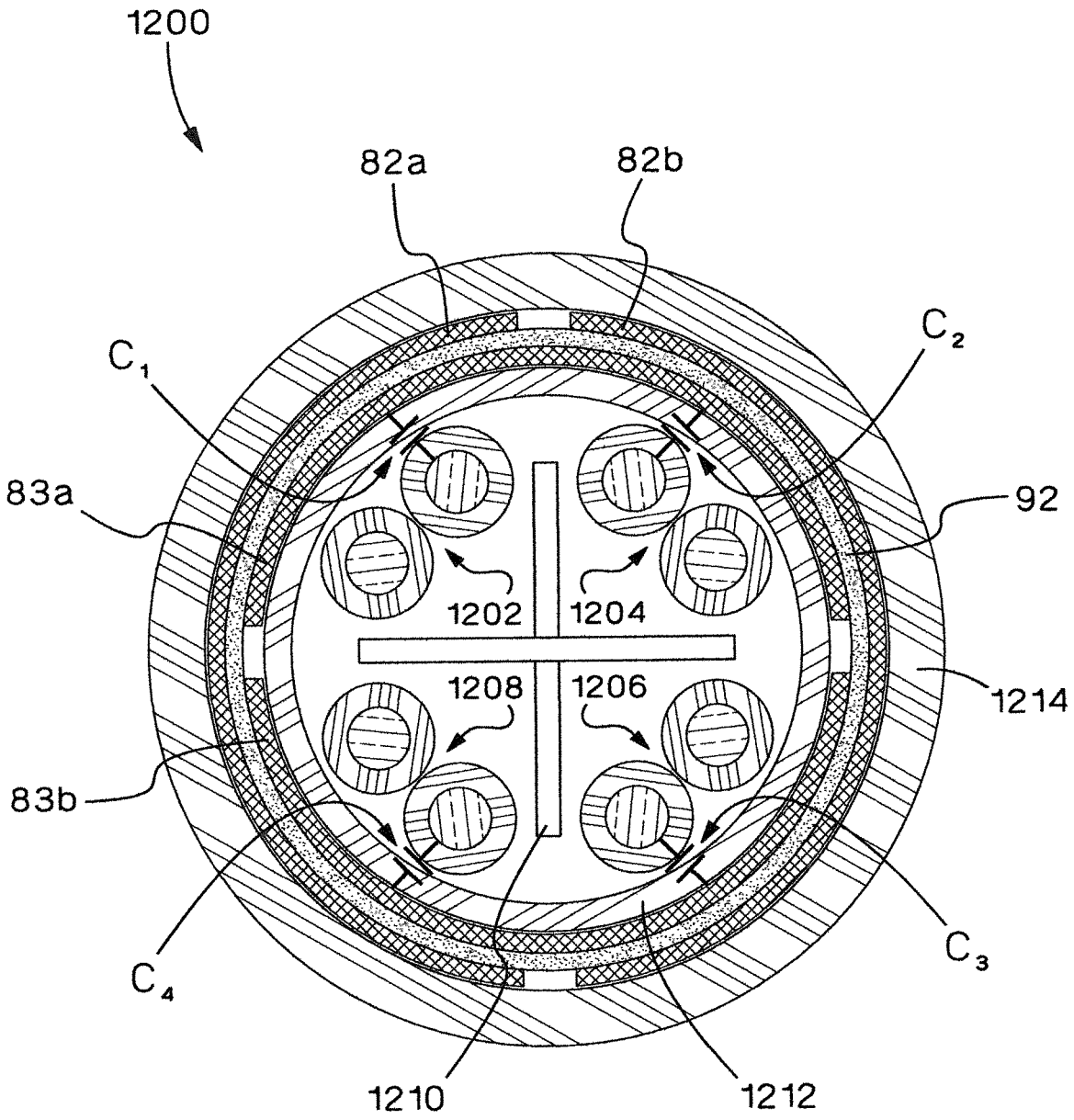
FIG. 12 is a cross-sectional view of a 10 Gb/s Ethernet U/UTP Cat 6a cable, in which a 2-brick, double-sided matrix tape is employed according to an embodiment of the present invention.

FIG. 12 is a cross-section view of a 10 Gb/s Ethernet U/UTP Cat 6a cable 1200, in which a 2-brick, double-sided matrix tape 80 (like the one illustrated in FIGS. 10 and 11) is employed. As can be easily seen with reference to FIGS. 10 and 11, the matrix tape 80 is double-sided, with each side including two parallel rows of rectangular conductive segments or bricks 82 and 83, separated by an insulative substrate 92. The cable further includes four wire pairs 1202-1208 separated from one another by a cross web 1210. A barrier 1212 (inner insulating layer) surrounds the wire pairs 1202-1208 and the cross web 1210. An outer insulating jacket 1214 surrounds the matrix tape 80, which is spiral-wrapped around the barrier 1212.

The 2-brick, double-sided configuration for the matrix tape 80 shown in FIG. 12 results in capacitive couplings C1, C2, C3, and C4, as well as others which are not shown for simplicity. C1 is the coupling between the first wire pair 1202 and the matrix tape 80, C2 is the coupling between the second wire pair 1204 and the matrix tape 80, C3 is the coupling between the third wire pair 1206 and the matrix tape 80, and C4 is the coupling between the fourth wire pair 1208 and the matrix tape 80. As can be seen, the coupling between C1 and C2 is significant because C1 and C2 share a common brick 83*a* or conductive segment. Similarly, since C3 and C4 share common brick 83*b*, the coupling between C3 and C4 is significant. As a result, the crosstalk between the first and second pairs 1202 and 1204 is significant and the crosstalk between the third and fourth pairs 1206 and 1208 is significant. This internal crosstalk is undesired, as it degrades the performance of the cable 1200.

Figure 13:
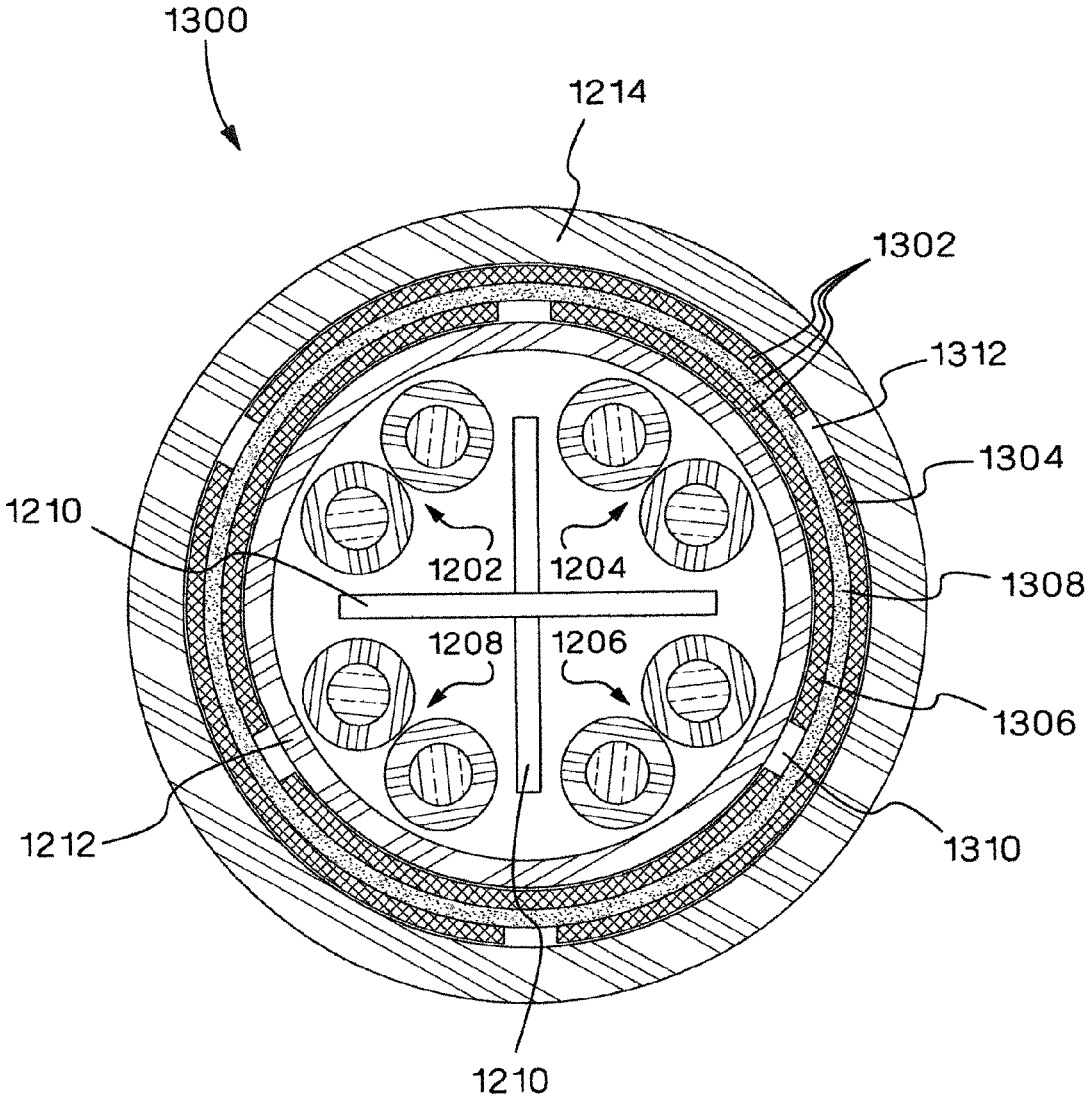
FIG. 13 is a cross-sectional view of a 10 Gb/s Ethernet U/UTP Cat 6a cable, in which a 3-brick, double-sided matrix tape is employed according to an embodiment of the present invention.
Figure 14:
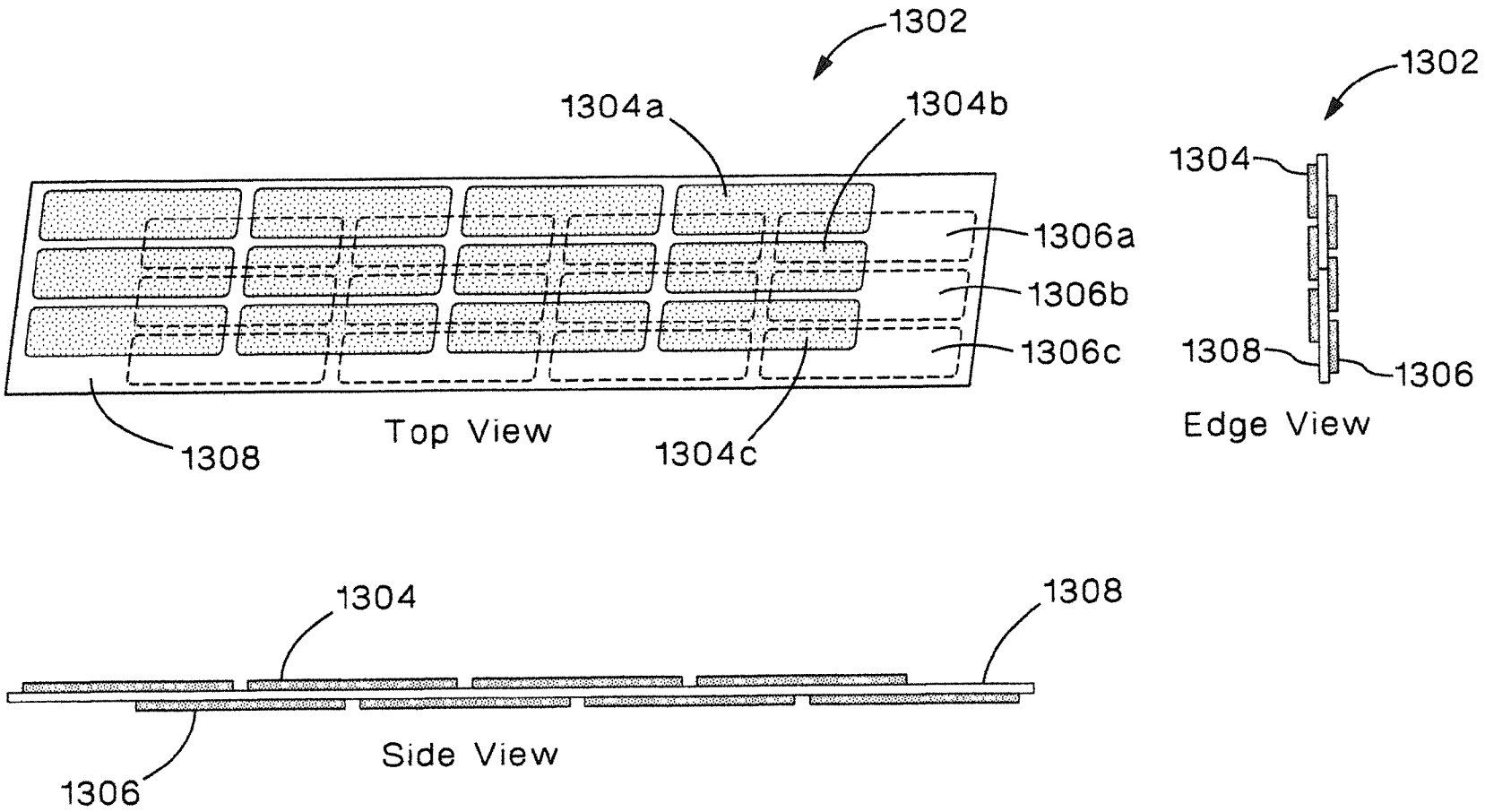
FIG. 14 is a 3-brick, double-sided matrix tape according to an embodiment of the present invention.
Figure 15:
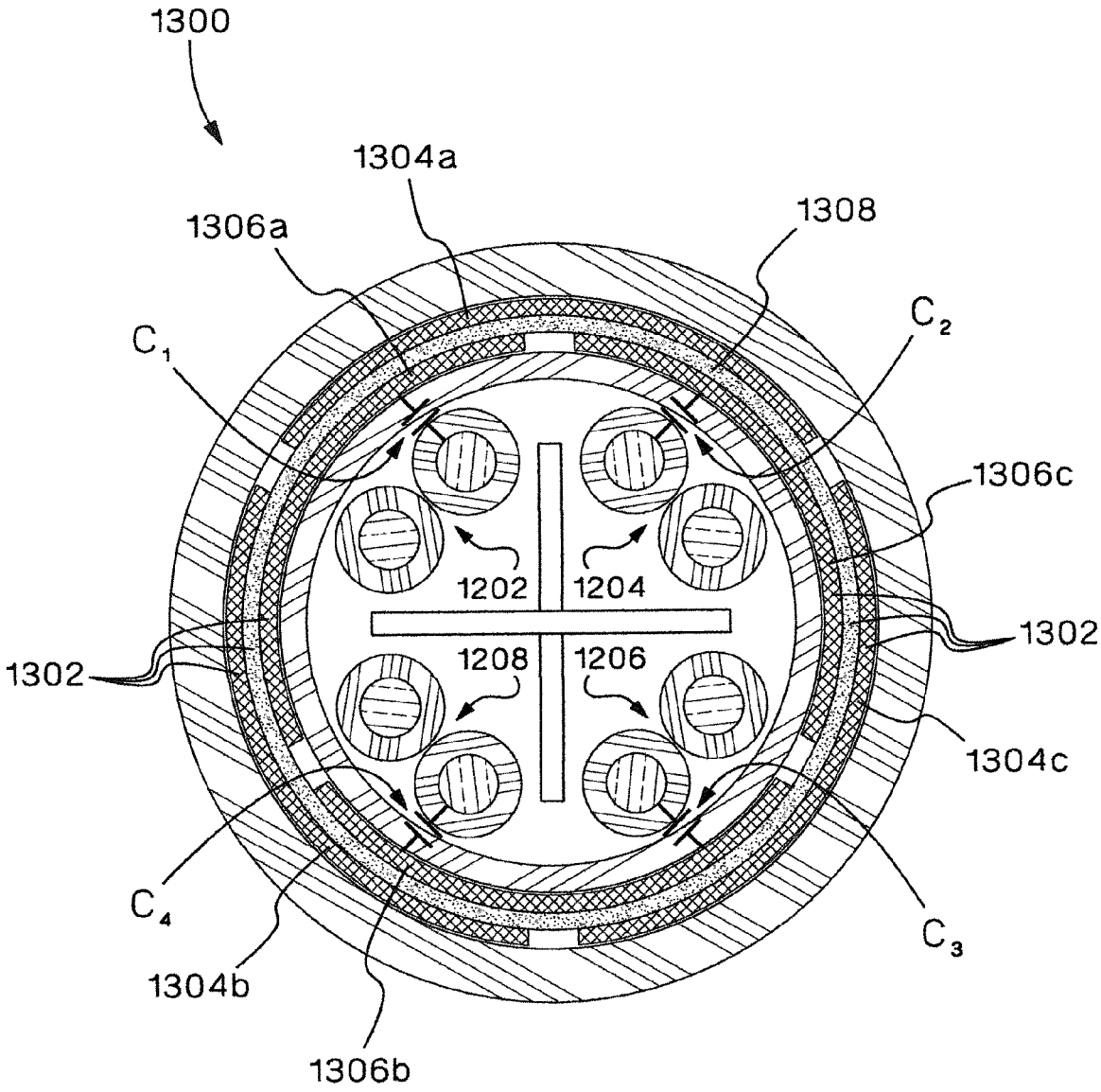
FIG. 15 is a cross-sectional view of a 10 Gb/s Ethernet U/UTP Cat 6a cable, in which a 3-brick, double-sided matrix tape is employed according to an embodiment of the present invention.

FIGS. 13-15 illustrate a 10 Gb/s Ethernet U/UTP Cat 6a cable 1300, in which a 3-brick, double-sided matrix tape 1302 (see FIG. 14) is employed. Each side of the double-sided matrix tape 1302 includes three parallel rows of rectangular conductive segments or bricks 1304 and 1306, separated by an insulative substrate 1308. The upper bricks 1304 and lower bricks 1306 substantially overlap each others' respective gaps 1310 and 1312 to attenuate alien crosstalk between the cables and neighboring cables. Other portions of the cable 1300 are largely similar to the cable 1200 of FIG. 12; thus, like numbering has been used.

Like the 2-brick, double-sided configuration for the matrix tape 80 shown in FIG. 12, the 3-brick, double-sided configuration for the matrix tape shown in FIGS. 13-15 results in capacitive couplings C1, C2, C3, and C4, as well as others which are not shown for simplicity. However, unlike the 2-brick configuration, the 3-brick configuration has minimal coupling between C1 and C2, since C1 and C2 do not share a common brick. Instead, C1 is coupled to brick 1306*a* and C2 is coupled to brick 1306*b*. Thus, because bricks 1306*a* and 1306*b* are separate conductive segments, the internal NEXT between the first and second pairs 1202 and 1204 is minimal. Since C3 and C4 share common brick 1306*b*, the coupling between C3 and C4 is significant. As a result, the internal NEXT between the third and fourth pairs 1206 and 1208 is significant. Thus, for the 3-brick, double-sided cable 1300, while internal NEXT is still significant between pairs 3 and 4, the internal NEXT for pairs 1 and 2 is improved over the cable 1200 of FIG. 12.

Figure 16:
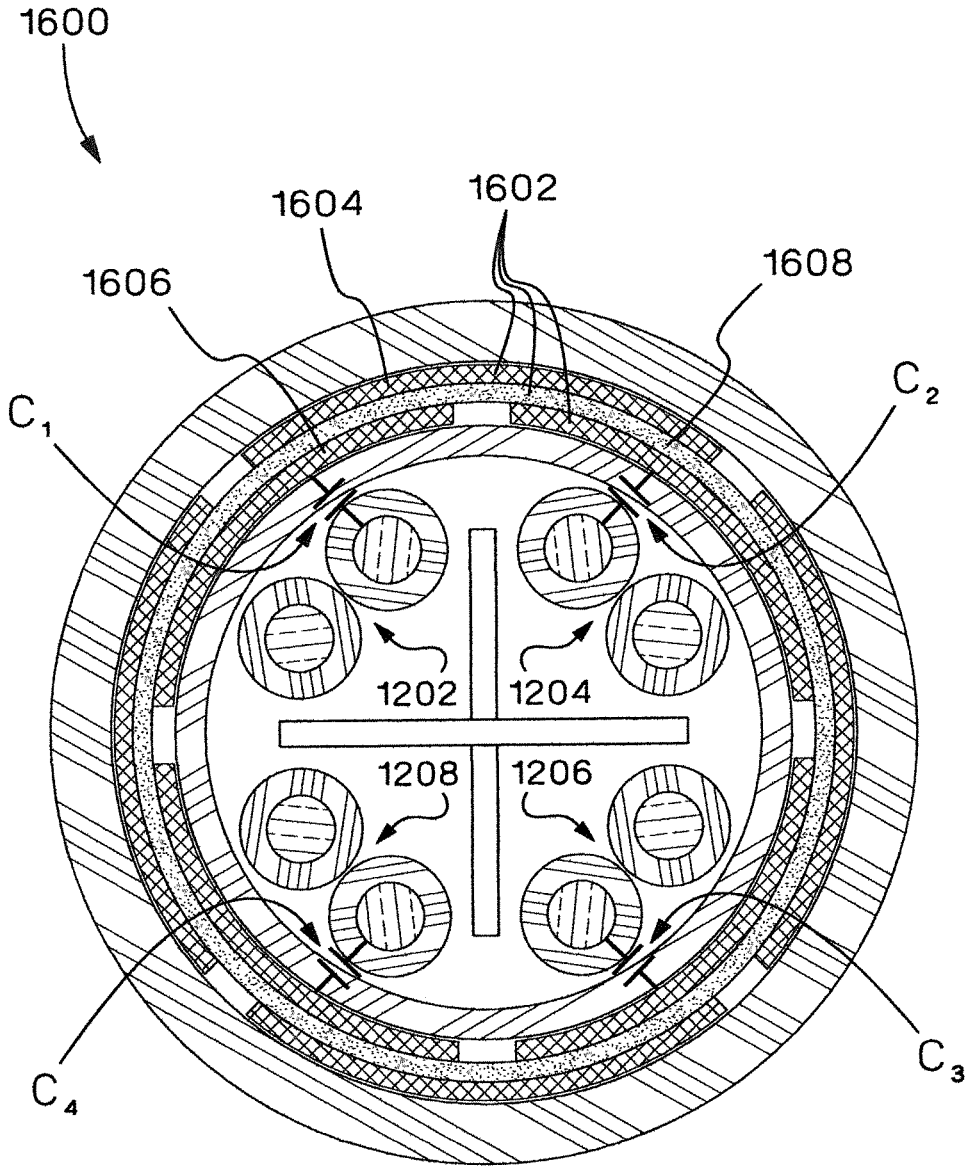
FIG. 16 is a cross-sectional view of a 10 Gb/s Ethernet U/UTP Cat 6a cable, in which a 4-brick, double-sided matrix tape is employed according to an embodiment of the present invention.

FIG. 16 is a cross-section view of a 10 Gb/s Ethernet U/UTP Cat 6a cable 1600, in which a 4-brick, double-sided matrix tape is employed. As can be seen, couplings C1-C4 are each coupled to separate bricks 1602-1608, so that there is minimal coupling between each of C1-C4. Therefore, the internal NEXT for neighboring pairs 1202-1206 is also minimal. One might expect to see that as the number of bricks is increased the coupling between all wire pairs is reduced. However, a disadvantage to having a large number of bricks is that a corresponding large number of gaps and brick edges are created. This increase in the amount of gaps and brick edges greatly reduces the inductive coupling attenuation between neighboring cables and thus, alien crosstalk attenuation is sacrificed.

As has been shown above, with reference to FIGS. 12-16, the design of the matrix tape itself is a parameter that may be used to control capacitive coupling between two wire pairs through the matrix tape. To balance competing objectives of (1) attenuating alien crosstalk between neighboring cables and (2) reducing internal NEXT with a cable, a preferred configuration for the matrix tape is the 3-brick, double-sided configuration shown in FIGS. 13 and 14. Of course, both indices (alien crosstalk and internal NEXT) would improve if inner insulating layer thickness were increased or if the inner insulating layer's DDR were substantially increased. Doing so, however, would also increase the diameter of the cable, which is typically undesirable.

Avoidance of Coherent Differential Mode Coupling in a Cable Utilizing Matrix Tape Introducing matrix tape into a cable's construction helps to meet alien crosstalk specifications (e.g. as defined by TIA 568C). The matrix tape technique (in contrast to air gaps or spacing between cables) additionally reduces the cable's diameter (e.g. from 350 mils to possibly 280 mils or lower). This reduction in diameter is beneficial when installing cable into a facility. However, depending on the particular design of the matrix tape, the alien crosstalk at certain frequencies can be accentuated, due to high differential mode coupling between the cables. This coupling is referred to as coherent differential mode coupling due to the degree of coherence required between the applied differential mode signal (residing on the twisted wire pairs) and the periodicity of the interaction between the metallic shapes in the matrix tape and the lay length of the wire pairs. The amplitude and bandwidth of the coherent differential mode coupling response is related to the precision or exactness of the matrix tape periodicity and the twisted wire pair lay lengths. The bandwidth of the peak's response widens as these lengths vary. This coherent differential mode coupling can make it difficult for a cable to meet the alien crosstalk specifications, if certain design precautions (set forth below) are not taken.

Coherent differential mode coupling is primarily a potential problem in configurations where fixed lengths of metallic shapes are utilized in a fixed periodic pattern. The embodiments illustrated in FIGS. 2-4, 6, and 8-16 are examples of such configurations. Matrix tapes employing random patterns or pseudo random patterns of metallic shapes are less susceptible to coherent differential mode coupling because the number of options for twisted wire pair lay lengths is increased. True randomness is preferred because the dependency between the twisted wire pair lay and the length periodicity of the metallic shapes is removed. However, typical manufacturing processes often are unable to achieve true random patterns or even significant pseudorandom pattern lengths. As a result, matrix tapes commonly have metallic shapes of fixed periodic length.

With metallic shapes of fixed periodic length, the challenge becomes one of tuning wire pair lengths to the fixed periodic length in order to avoid coherent differential mode coupling in the frequencies of interest. FIGS. 17-28 and the accompanying discussion describe coherent differential mode coupling (and coupling generally) and set forth the basis for the process of tuning wire pair lengths to the fixed periodic length. In the examples shown, the cable is a 10 Gb/s Ethernet U/UTP Cat 6a cable, in which a 3-brick, double-sided matrix tape 1302 is employed. See FIGS. 13-15.

Figure 17A:
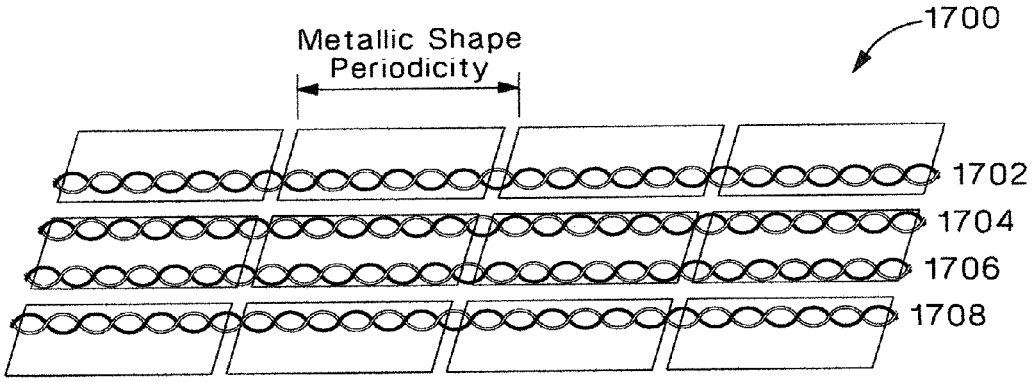
FIGS. 17A-C are conceptual diagrams illustrating equivalent perspectives of metallic shapes (i.e. bricks or conductive segments) from a matrix tape in relation to twisted wire pairs overlain by the metallic shapes.
Figure 17B:
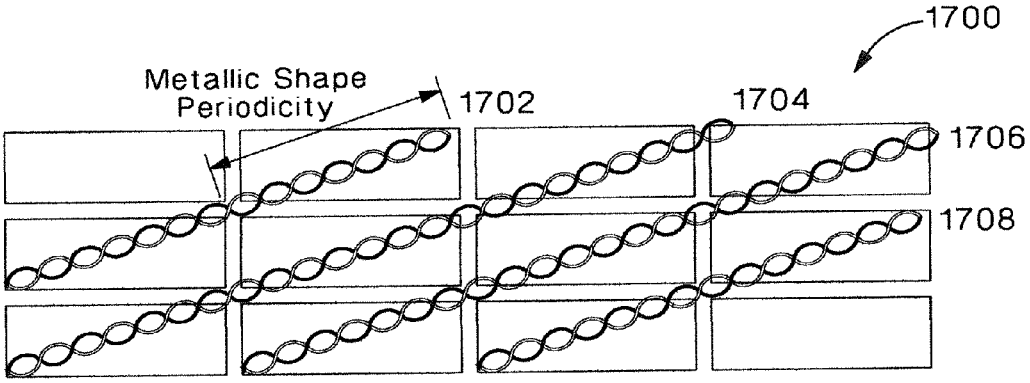
Figure 17C:
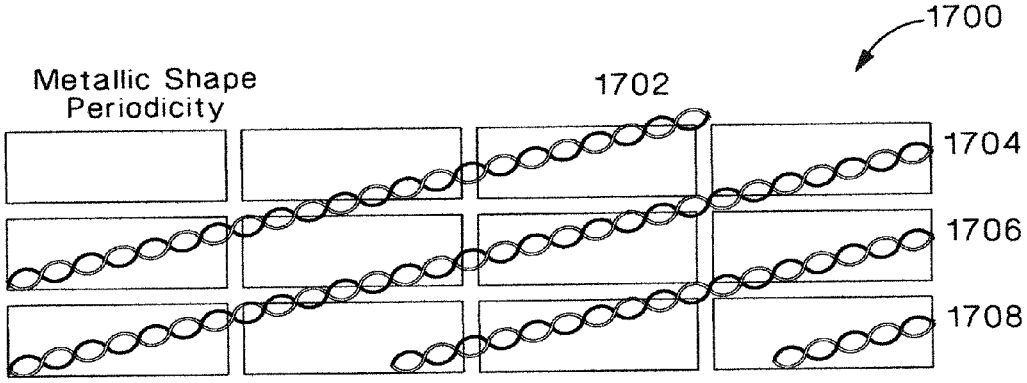

FIGS. 17A-C are conceptual diagrams illustrating equivalent perspectives of metal shapes (i.e. bricks or conductive segments) from a matrix tape in relation to twisted wire pairs overlain by the metallic shapes. Note that these equivalent perspectives do not accurately represent the physical construction of the cable and are intended to illustrate relative placements between metal shapes and corresponding twisted wire pairs.

FIG. 17A illustrates the case where the matrix tape is helically wound around the cable with the same cable strand lay as the wire pairs experience. In this case, the periodicity of the metallic shapes 1700 is equal to the periodicity of the dimensions (i.e. longitudinal length and transverse width) on the tape itself.

FIG. 17B illustrates the case where the matrix tape is wrapped in a longitudinally configuration. As shown here, the periodicity of the tape's metallic shapes 1700 is approximately equal to the diagonal of the shapes. Similarly, FIG. 17C illustrates a case where the periodicity is more complex and accordingly, the calculation for the coherent differential mode coupling frequency is more complex.

Figure 18:
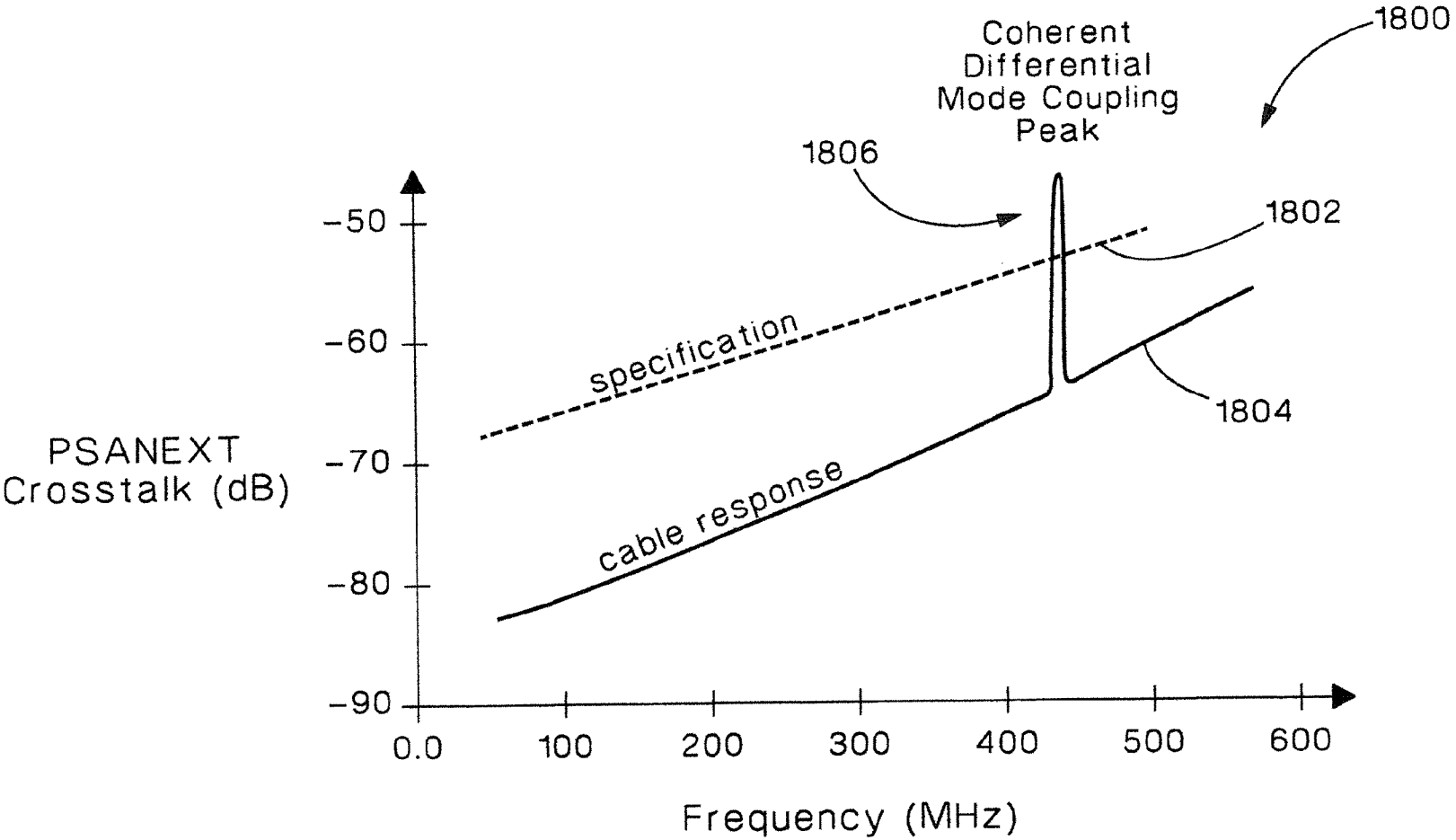
FIG. 18 is a graph showing the power sum alien NEXT (PSANEXT) specification and cable response level for a cable construction employing a matrix tape having a specific metallic shape periodicity such that there exists a high level of differential mode coupling near 440 MHz between two similarly constructed cables.

FIG. 18 is a graph 1800 showing the power sum alien NEXT (PSANEXT) specification 1802 and a cable response level 1804 for a cable construction employing a matrix tape having a specific metallic shape periodicity such that there exists a high level of coherent differential mode coupling 1806 near 440 MHz between two similarly constructed cables. This particular illustrated cable design fails the specification that is required for U/UTP Cat 6A 10G Base-T applications. Note that the alien crosstalk performance outside of the peak coupling at 440 MHz meets the specification quite well with significant margin. With a modification to the length of the periodicity of the metallic shapes and/or a change in the length of the wire pair lays, as described below and used in the present invention, the high degree of coupling shown in graph 1800 can be eliminated.

There are two fundamental coupling mechanisms by which alien crosstalk can occur between twisted wire pairs in two similarly different constructed cables: an electro-magnetic radiative coupling and a non-radiative coupling mechanism based on capacitive and inductive coupling. The non-radiative mechanisms dominate for alien crosstalk primarily due to the proximity of neighboring cables and the frequency range of interest (e.g., 1 MHz to 500 MHz). The following discussion is directed to these non-radiative coupling mechanisms. An understanding of these coupling mechanisms assists in understanding the nature of coherent differential mode coupling.

FIGS. 19A-D and 20A-D are conceptual diagrams illustrating differential mode (DM) and common mode (CM) alien crosstalk coupling mechanisms for U/UTP cables without (FIGS. 19A,C) and with (FIGS. 19B,D and 20A-D) the incorporation of matrix tape. The figures illustrate how the matrix tape (a discontinuous periodic set of metallic shapes) can provide attenuation to these coupling mechanisms.

In FIGS. 19A-D, the magnitudes of the couplings are represented by the length and boldness of the arrows (where a longer length and/or a bolder arrow equate to a higher magnitude). DM coupling dominates over CM coupling in a typical U/UTP cable because the propagating signal on the wire pair is DM, and the conversion from DM to CM is so low (e.g., −40 dB).

Figures 19A, 19B:
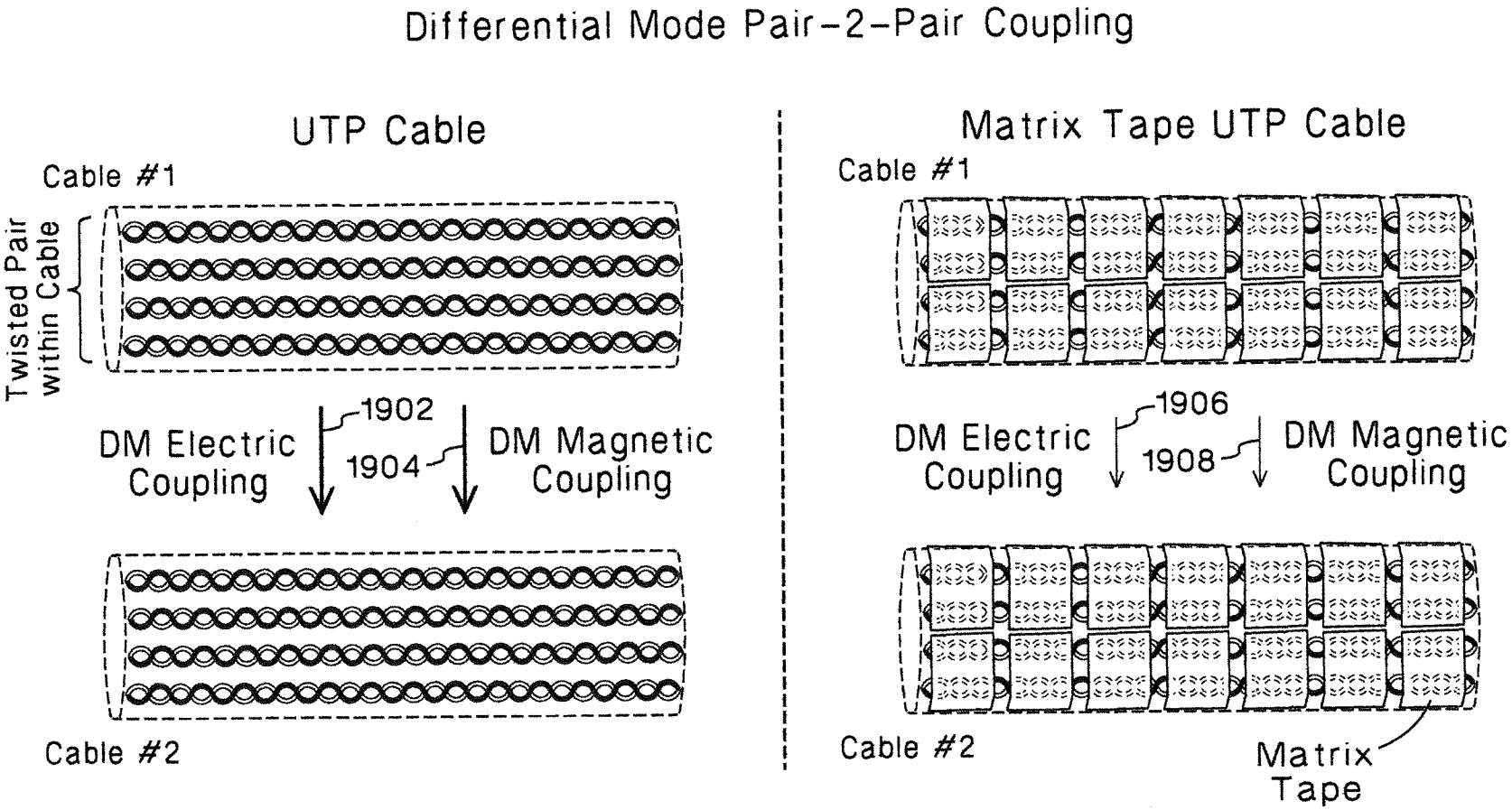
FIGS. 19A-D are conceptual diagrams illustrating differential mode and common mode alien crosstalk coupling mechanisms for U/UTP cables with and without matrix tape.
Figure 19D:
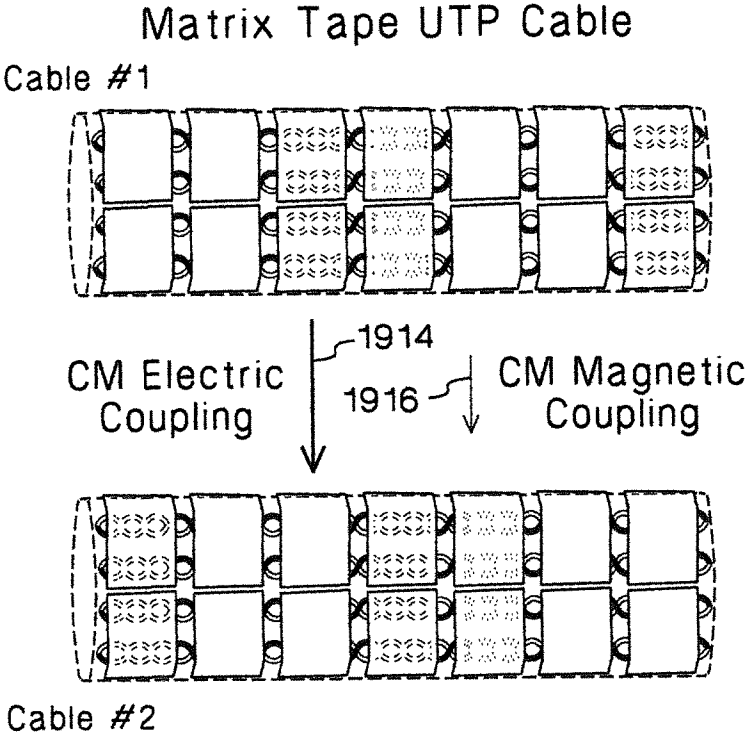

FIG. 19B shows that the DM coupling (both electric and magnetic) is greatly reduced (from that shown in FIG. 19A) when matrix tape is incorporated into the cable. The responsible attenuation mechanisms are described in FIGS. 20A and 20C. Similarly, FIG. 19D shows that the CM electrical (capacitive) coupling is slightly increased, and the CM magnetic (inductive) coupling is slightly reduced. The responsible attenuation mechanisms are described in FIGS. 20B and 20D. FIGS. 20A-D will now be described in further detail.

Figure 20A:
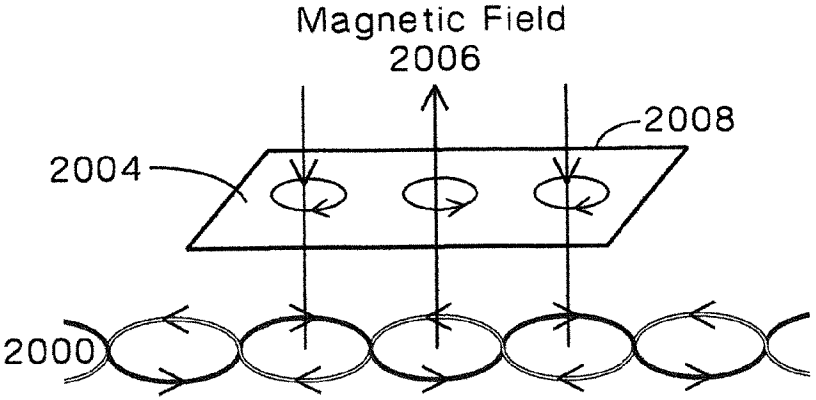
FIGS. 20A-D are conceptual diagrams illustrating differential mode and common mode alien crosstalk coupling mechanisms for U/UTP cables with matrix tape.
Figure 20B:
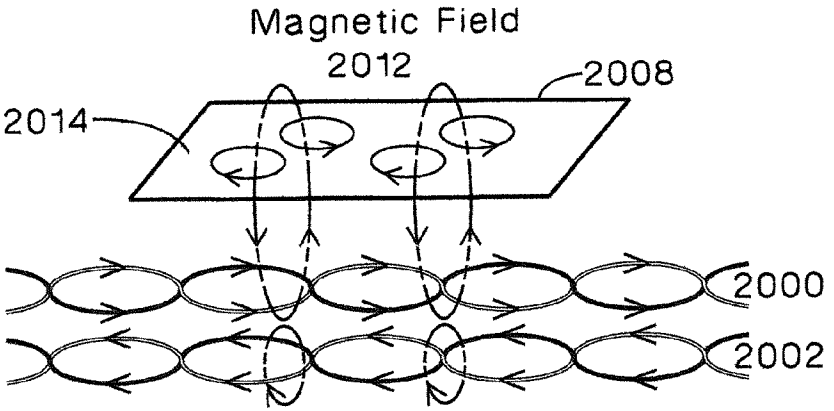
Figure 20C:
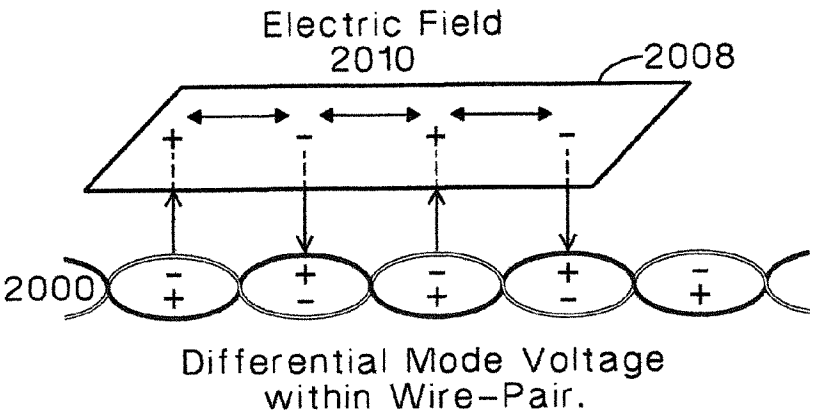
Figure 20D:
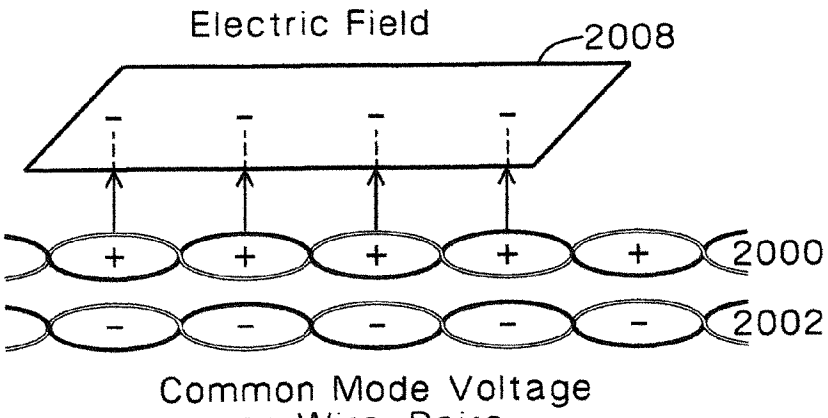

FIGS. 20A-D illustrate two attenuation mechanisms. FIGS. 20A and 20C illustrate differential mode magnetic and electric coupling, while FIGS. 20B and 20D illustrate common mode magnetic and electric coupling.

For magnetic (inductive) coupling arising from the differential current in the wire pair 2000 (as shown in FIG. 20A) between two twisted wire-pairs 2000 and another wire pair (not shown) in two different but similarly constructed cables, an eddy current 2004 is created where the magnetic field 2006 passes through the metallic shapes 2008. This eddy current provides power loss (at a rate of the resistance multiplied by the square of the current) to the magnetic field 2006 and hence reduces the alien crosstalk associated with magnetic coupling. FIG. 20C shows how the magnitude of the electric field is attenuated due to a differential mode signal on the wire-pair 2000. The metallic shape 2008 provides a substantially equal potential across the length of the wire pair 2000 that the metallic shape 2008 covers, and thus provides an averaging effect over the coverage length. The equal-potential value tends towards zero as the covered length approaches an integer multiple of wire pair periods. Similarly, the equal-potential value tends towards a maximum magnitude as the covered length approaches a half-integer multiple of wire pair periods. Lowering the equal-potential value lowers the electric field coupling between wire pairs of different cables.

Figure 19C:
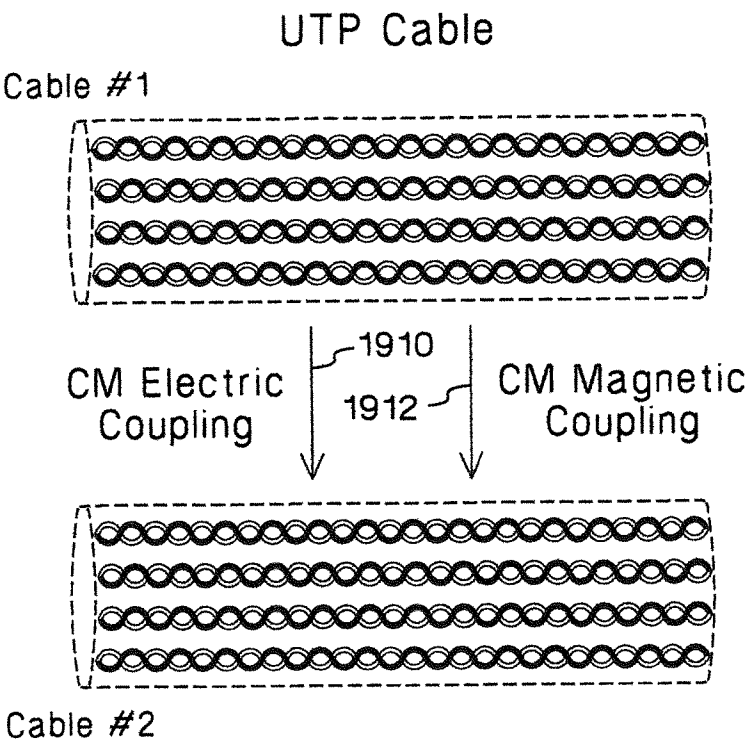

With respect to common mode coupling, FIGS. 19C and 19D showed how magnetic field coupling is slightly attenuated and electric field coupling is actually slightly increased. FIG. 20B illustrates that the magnitude of the magnetic field 2012 is only slightly attenuated due to the shape of the magnetic field. This is because only the normal vector component of the magnetic field 2012 in reference to the metallic shape 2008 produces an eddy current 2014. Since the normal component is smaller than the corresponding normal component in a DM signal, this results in a smaller attenuation. The electric field coupling is actually stronger due to the size of the metallic shape 2008 that is covering a length of the wire pair 2000 at a common magnitude of potential. Here the metallic shapes are essentially acting as a physical "spreader", thereby providing easier cable-to-cable coupling.

The above description of the primary coupling mechanisms responsible for alien crosstalk provides a basis for understanding how coherent differential mode coupling can occur between communication cables having spiral-wrapped matrix tape with periodic metallic shapes of fixed length. FIGS. 21-25 are conceptual diagrams illustrating settings in which coherent differential mode coupling can occur. These figures reference bricks (metallic shapes) 2100 and twisted pairs 2102 and 2104

Figure 21A:
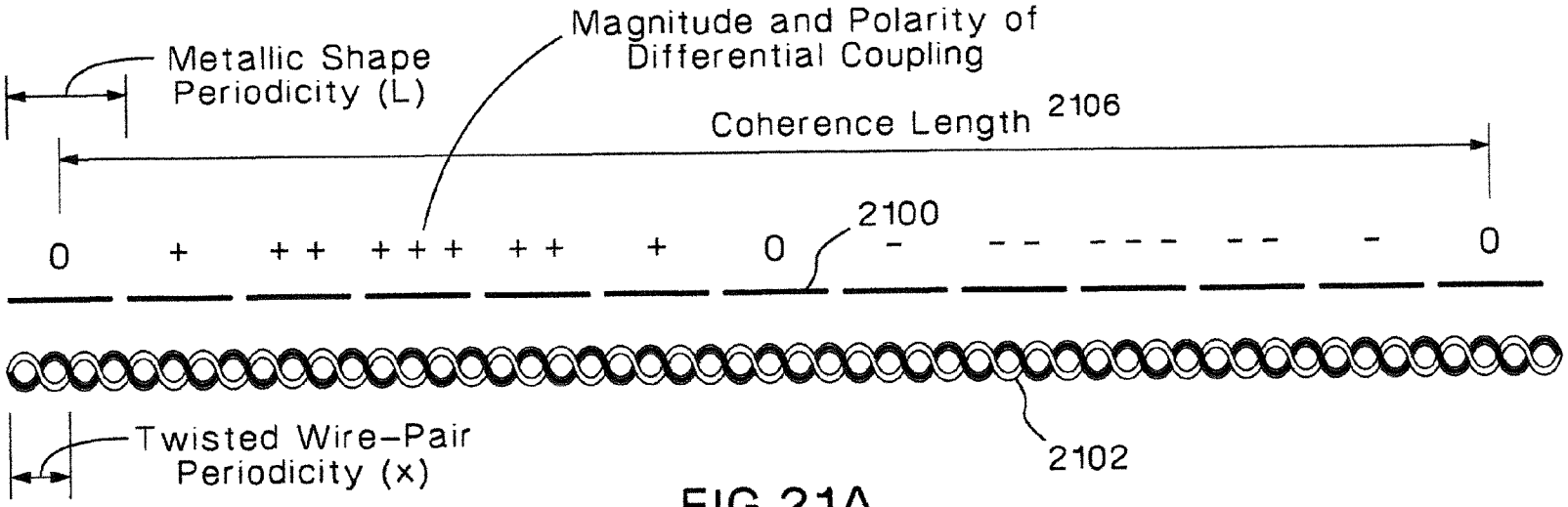
FIG. 21A is a conceptual diagram illustrating coherence length as a function of metallic shape periodicity and twisted wire pair periodicity.
Figure 21B:
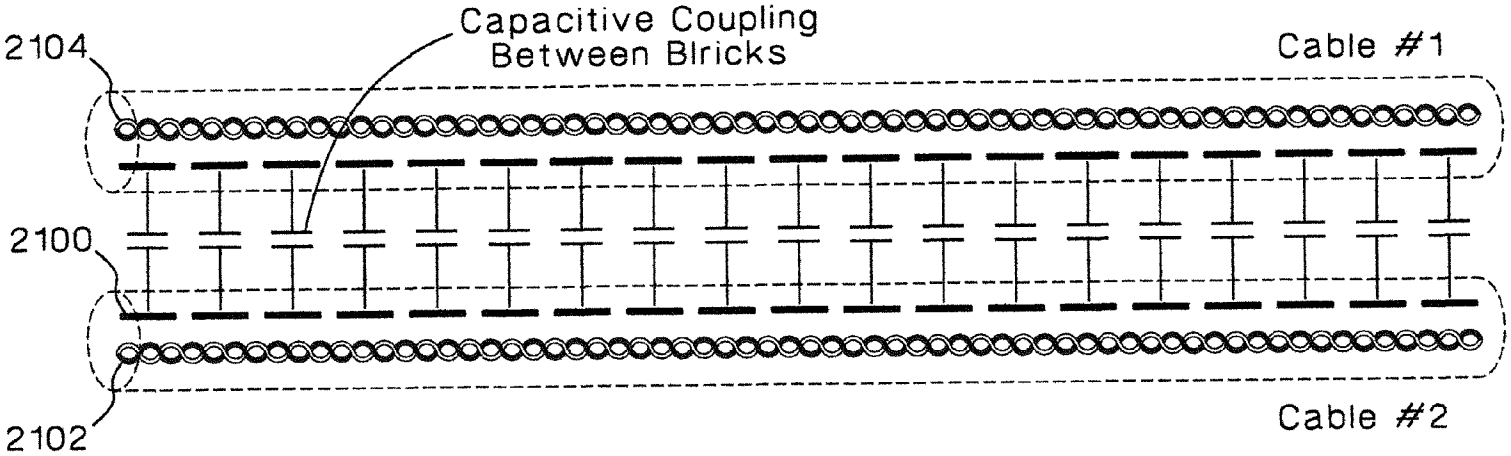
FIG. 21B is a conceptual diagram illustrating capacitive coupling between bricks in two neighboring cables.
Figure 22A:
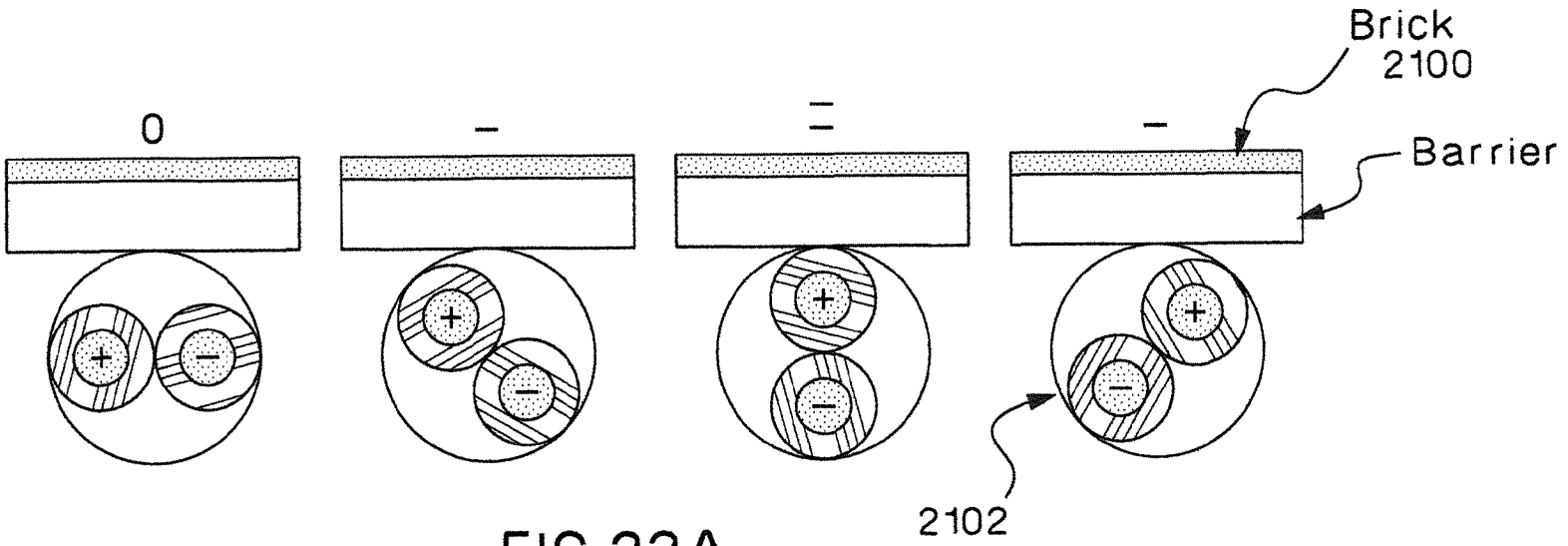
FIGS. 22A-B are conceptual diagrams illustrating the relative charge on a brick as a twisted pair twists under the brick, shown as successive cross-sections progressing longitudinally along a cable.
Figure 22B:
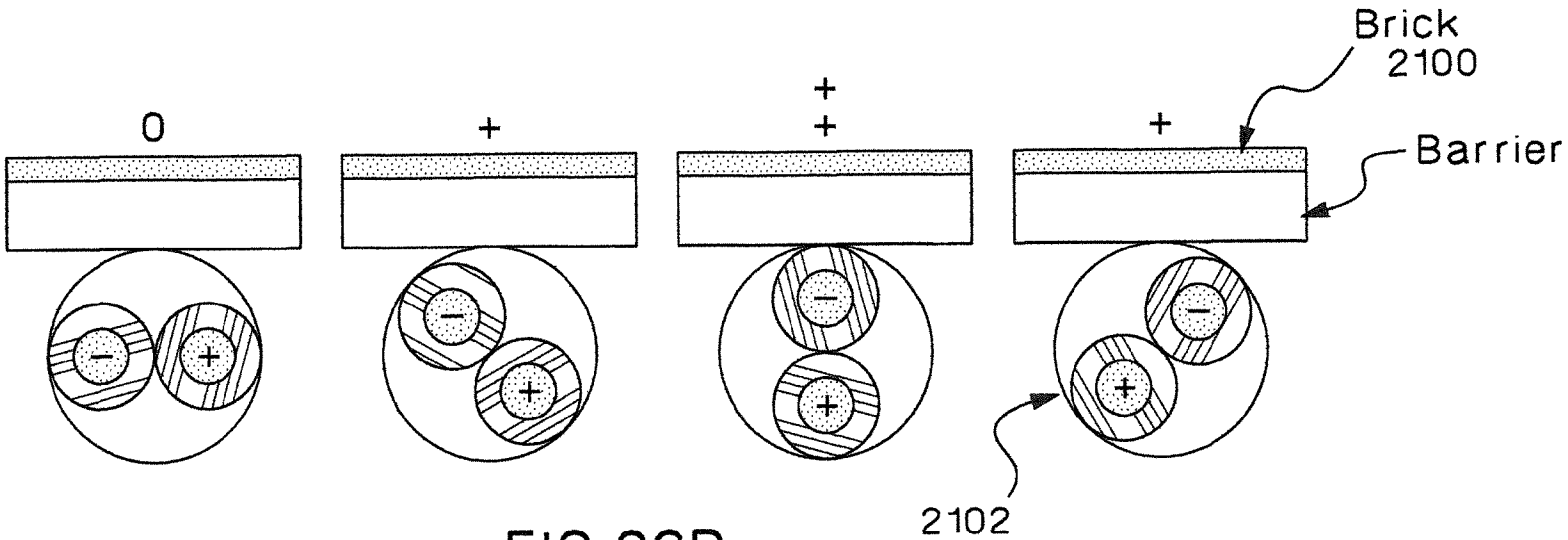
Figure 23A:
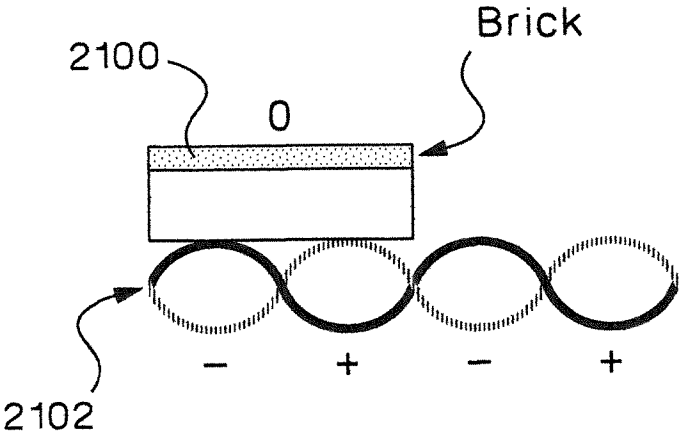
FIG. 23A-D are conceptual side view diagrams illustrating the relative charge on a brick as brick length changes with respect to twist pair lay.
Figure 23B:
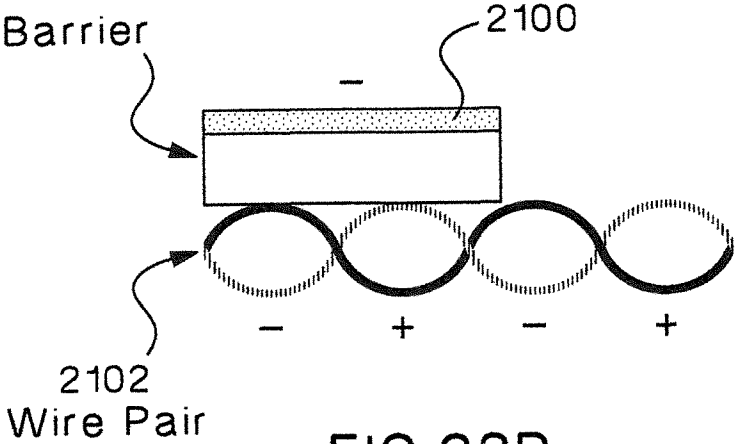
Figure 23C:
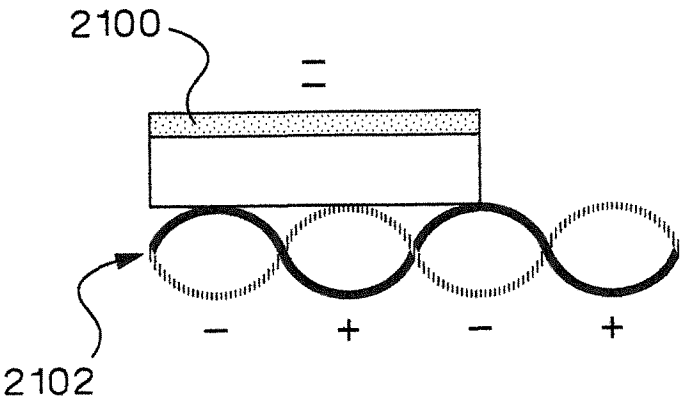
Figure 23D:
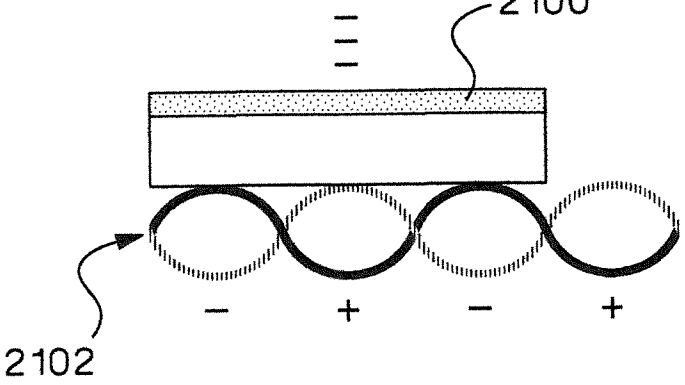
Figure 24A:
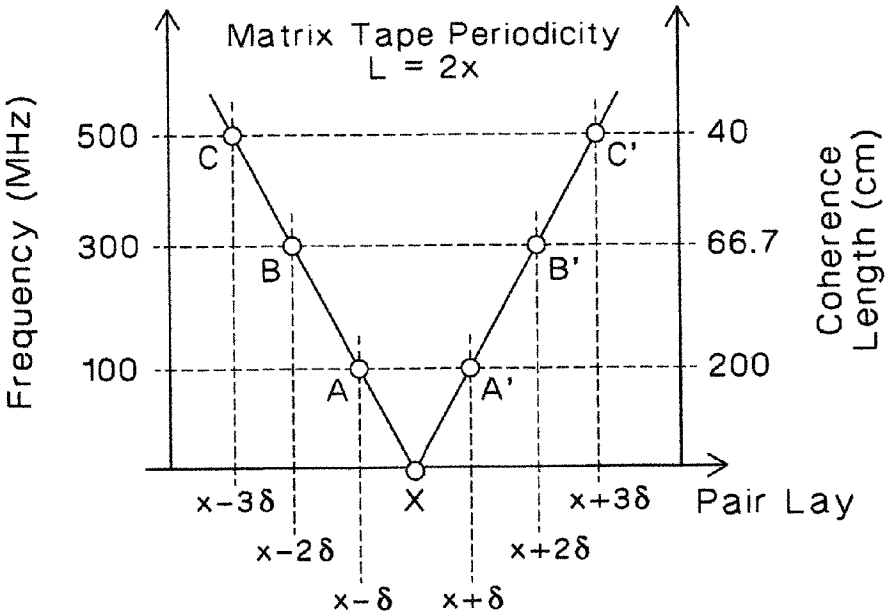
FIG. 24A is a graph illustrating the frequencies at which coherent differential mode coupling occurs for different multiples of the offset between matrix tape periodicity and twist pair lay.
Figure 24B:
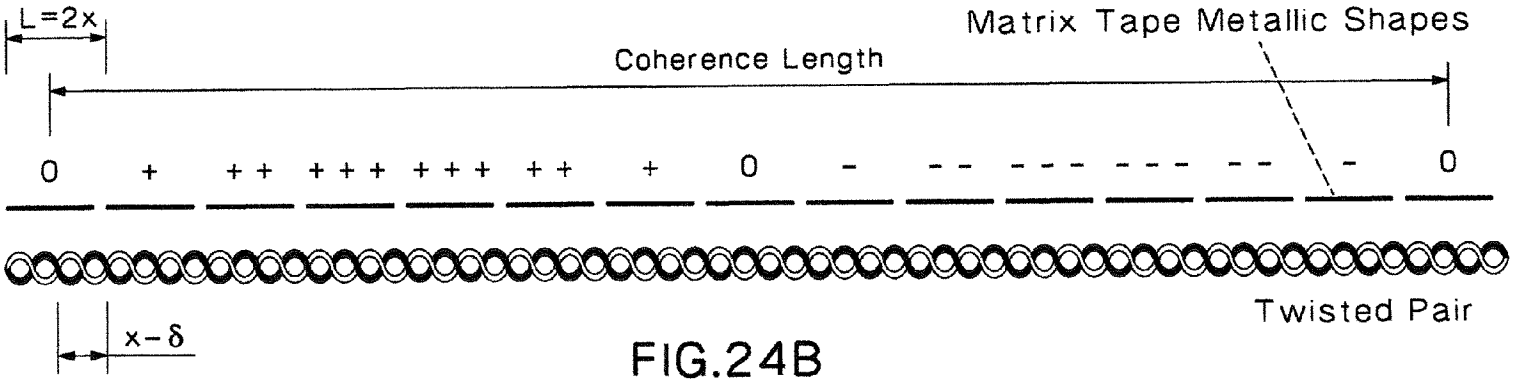
FIGS. 24B-D are conceptual diagrams illustrating coherence length dependency on an offset between matrix tape periodicity and twist pair lay.
Figure 24C:
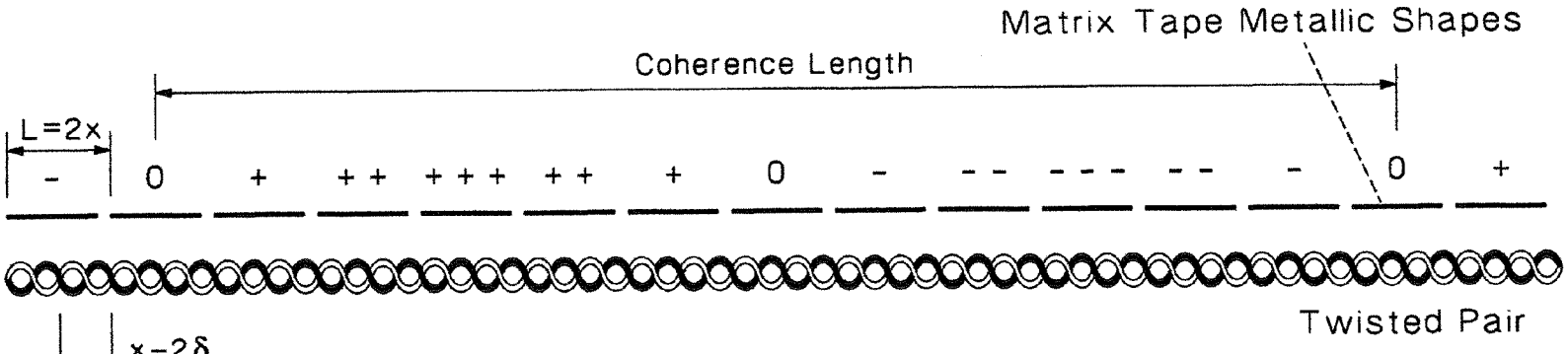
Figure 24D:
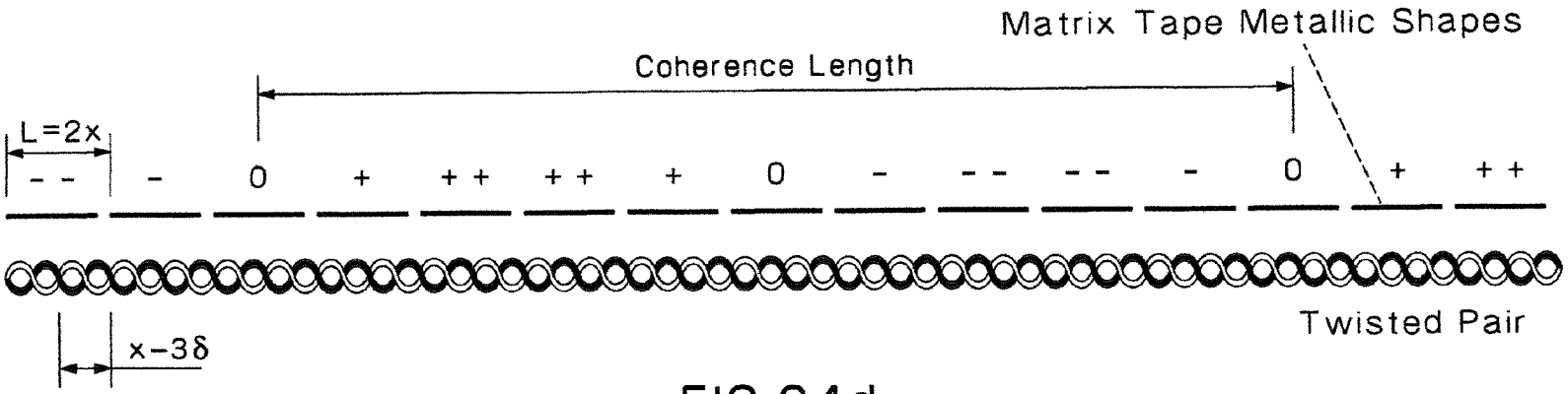

As shown in FIG. 21A, for a particular metallic shape periodicity (of length L), there exists twisted wire pair lays (with periodicity x) that produce non-zero equal-potentials on the metallic shapes that make up the matrix tape. The non-zero equal-potentials in such a periodic relationship can have periodic values along the longitudinal direction, with each period having a characteristic periodic length ("coherence length" 2106). FIGS. 22A-B and 23A-D illustrate this symbolically, in transverse and longitudinal cross-sections along the cable's length, respectively. FIGS. 22A-B illustrate the relative charge on the brick 2100 as the twisted pair 2102 twists under the brick 2100. FIGS. 23A-D illustrate the relative charge on the brick 2100 as the length L of the brick 2100 changes relative to the pair lay x of the twisted pair 2102. When a differential mode signal is applied to a twisted wire pair that has such a periodic relationship between its lay length and with the matrix tape's metallic shape periodicity, a strong coupling can result between two twisted pairs between two similarly constructed cables. The coupling between the two twisted pairs of two different cables is largely capacitive, as shown in FIG. 21B. This strong coupling occurs if the applied signal is coherent to the longitudinally periodic equal-potentials (or said in another way, if the wavelength of the applied signal is equal to the coherence length 2106 as previously defined and shown in FIG. 21A).

The coherence length 2106 (defined as the period of the periodic equal-potentials) indicates at which signal frequency a large coupling exists between neighboring cables of similar construction. It is preferred that this signal frequency (if it exists) be outside the frequency range of interest. The frequency range of interest is the frequency range of the application that the cable is transmitting (e.g., 10 Gb/s Base-T cables have an application frequency range between 1 and 500 MHz). Thus, it is desirable to produce a coherence length 2106 such that the pertinent signal frequency is outside of the frequency range of the application being transmitted.

To design a cable in which the signal frequency at which coherent differential mode coupling occurs is outside of the frequency range of interest, one may adjust values for L and x (defined above). The relationship between the coherence length 2106 and the signal frequency is:

$$\text{Frequency(Hz)}=(\text{phase velocity})/(\text{coherence length}).$$

The phase velocity is the velocity of propagation of the differential mode signal within the twisted wire pair. Typically this velocity (which is medium-dependent) is on the order of 20 cm/ns. Therefore, if a coherence length of 60 cm occurred, then the frequency of high coupling is approximately 333 MHz. This would look like the PSANEXT peak 1806 shown in FIG. 18, except it would occur at 333 MHz.

In order to create this form of coherent coupling, the periodicity L of the metal shapes 2100 making up the matrix tape must be an integer multiple or half-integer multiple of the twisted wire pair lay length x. Furthermore, when this condition exists, the resulting coherence length 2106 is dependent on the length difference δ between the twisted wire pair lay length x and the metallic shape periodicity L. This length difference δ is equal to the magnitude of L minus x. Thus, when L is exactly equal to a multiple of x (i.e., $\delta=0$), the resulting coherence length is large (and the frequency is very low). However if there is a slight difference or offset between L and a multiple of x (i.e., δ is non-zero), the resulting coherence length can be shorter (the frequency will be larger) or longer (the frequency will be smaller).

FIGS. 24A-D illustrate the frequencies at which coherent differential mode coupling occurs for different multiples of δ (L minus x), when L=2x. This relationship can be used to construct a design guide for choosing "proper" values of L and x (note that all the twisted wire pairs must conform to this design guide). The limits for the twisted wire pair lay length x are such that the resulting frequency (as derived from the coherence length) be smaller than the largest frequency used in the application that it is designed for. For example, in 10G Base-T applications, the largest frequency specified is 500 MHz and hence the wire-pairs twist lay can be selected from values that do not result in a coherent frequency of less than 500 MHz. Hence the largest acceptable value for the coherence length that supports this application is 40 cm.

Figures 25A, 25B:
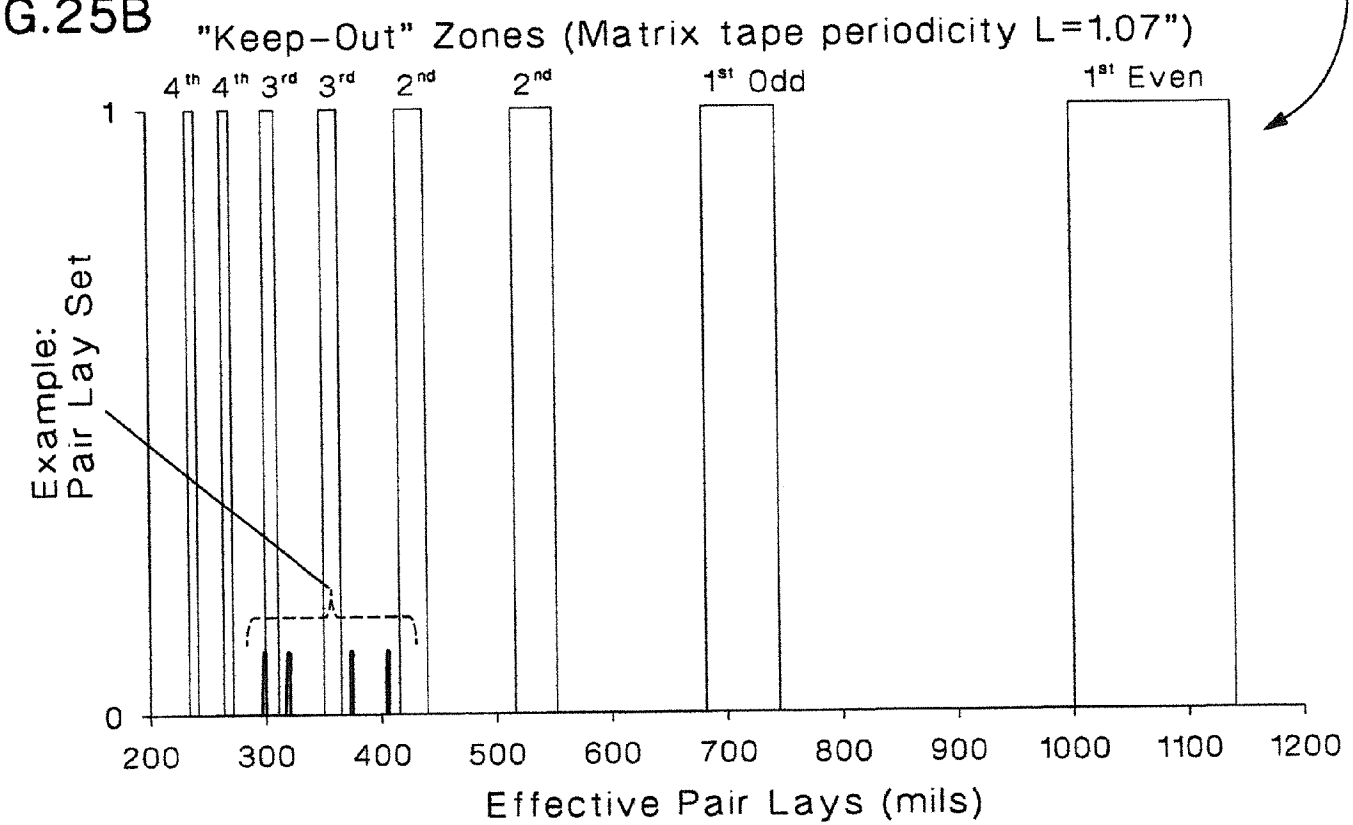
FIG. 25A is a chart listing "keep-out" twist lay lengths for a given periodicity of metallic shapes.
FIG. 25B is a chart of an example twisted pair lay set that conforms to the design guideline shown in FIG. 25A.

The above concepts can be used to create a chart of "keep-out" twist lay lengths for a given periodicity of metallic shapes. FIG. 25A illustrates an example 2300 of such a chart. FIG. 25B shows an example twisted pair lay set 2302 that conforms to this design guideline. In accordance with this guideline, neighboring cables will not experience high coherent differential mode coupling up to and including the maximum application frequency of 500 MHz.

There is a constraint on the maximum of the matrix tape's metallic length periodicity L, in that if the length L is long enough, then the coupling will have a small amplitude and a wide bandwidth. For example, the wavelength for a differential mode signal propagating on the twisted wire pairs at 200 MHz is approximately 100 cm. When the matrix tape's metallic shape periodicity L is on the order of 1 inch (2.54 cm), about 40 metallic shapes 2100 make up a coherence length 2106 at this frequency. The resulting response spectrum has a significantly large amplitude and a narrow bandwidth. However, if the shape periodicity is on the order of 10 inches (25.4 cm), there would only be four shapes that can make up a coherence length at the same frequency. If a coherent differential mode coupling were to exist using this 10-inch metallic shape periodicity L, the alien crosstalk response would have a peak with a smaller amplitude with a broad bandwidth.

Also note that metallic shape periodicity has an upper limit due to the susceptibility (and emissions) of radiative electromagnetic energy. This upper limit is valid (or important) primarily only in the case of when the wire pair 2102 has a low balance (i.e., DM to CM or CM to DM conversion within the cable or within the channel's connectivity). The effects at issue are when a CM signal is converted to DM and hence appears as a noise contributor, or when a DM signal converts to a CM signal and radiates (i.e., to a neighboring cable). When the metallic shape periodic length L has an integer-multiple relationship to the maximum frequency that it must support, then the matrix tape radiates energy from or into a common mode signal propagating onto the wire pair 2102. For example, at 500 MHz, the wavelength is about 40 cm for a common mode signal propagating on the twisted wire pair 2102. If the periodic length L of the metallic shapes 2100 are on the order of 10 cm (which corresponds to a quarter wavelength antenna), then the matrix tape efficiently radiates energy away from the cable. Of course, this system has reciprocity such that the matrix tape can receive this radiative energy from an outside source or from another similarly constructed cable. Either case contributes to undesirable alien crosstalk.

In addition to the upper limits on the metallic shape periodic length L, there is also a lower limit that is primarily set by the lay length x of the twisted wire pair 2102. The electromagnetic field attenuation is reduced as the metallic shape length L approaches (or is less than) that of a twisted wire pair lay length x. This sensitivity is again controlled by the attenuation attributed to the electric field and the magnetic field. For example, if the metallic shapes 2100 had lengths on the order of half the twisted wire pair length x, then there is a minimum of beneficial electric field attenuation due to the absence of the second half of the wire pair length that compensates for the first half. The beneficial attenuation of magnetic field coupling is also lessened when the metallic shape length L is smaller than the wire pair lay length x. The reduced attenuation is due primarily from an increased amount of metallic shape edges where the eddy current cannot set up effectively.

Figure 26A:
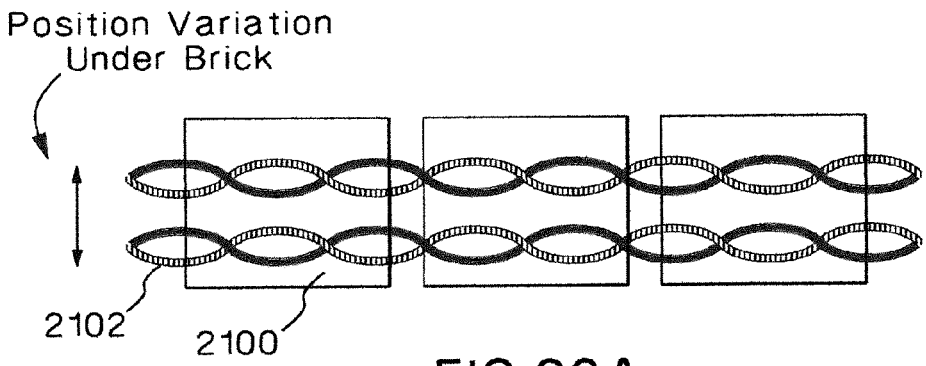
FIGS. 26A-B are schematic diagrams illustrating positional variation under a brick for a rectangular brick pattern and a non-regular parallelogram brick pattern.
Figure 26B:
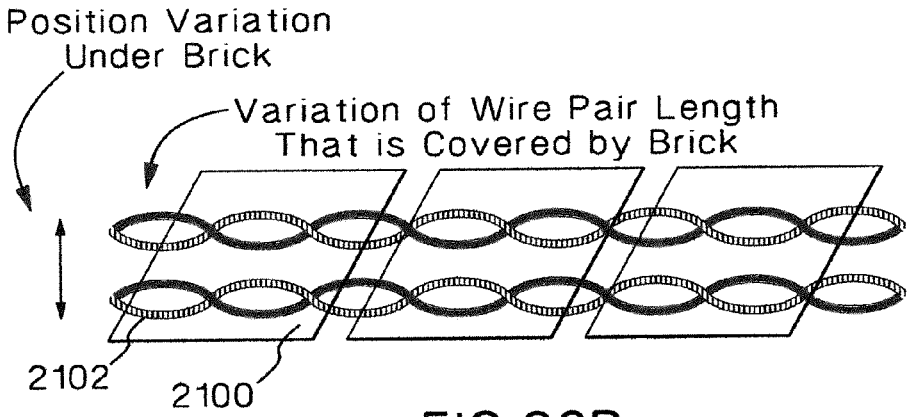

In addition to varying the metallic shape periodic length L or the lay length x, another technique involves utilizing the inherent variability in a wire pair's position (circumferentially in the cable) underneath a particular metallic shape (i.e., brick). This positional variation can be on the order of 60 mils. As shown in FIG. 26A, for a "rectangular" brick pattern, the positional variation of the wire pair 2102 does not change the region of the wire pair that the brick 2100 covers. However, as shown in FIG. 26B, for a non-regular parallelogram brick pattern, the positional variation of the wire pair 2102 can vary the region of the wire pair that the brick covers, changing the value of the enhanced charge and helping to break up any periodic longitudinal charge distribution that could lead to coherent differential mode coupling.

Figure 27:
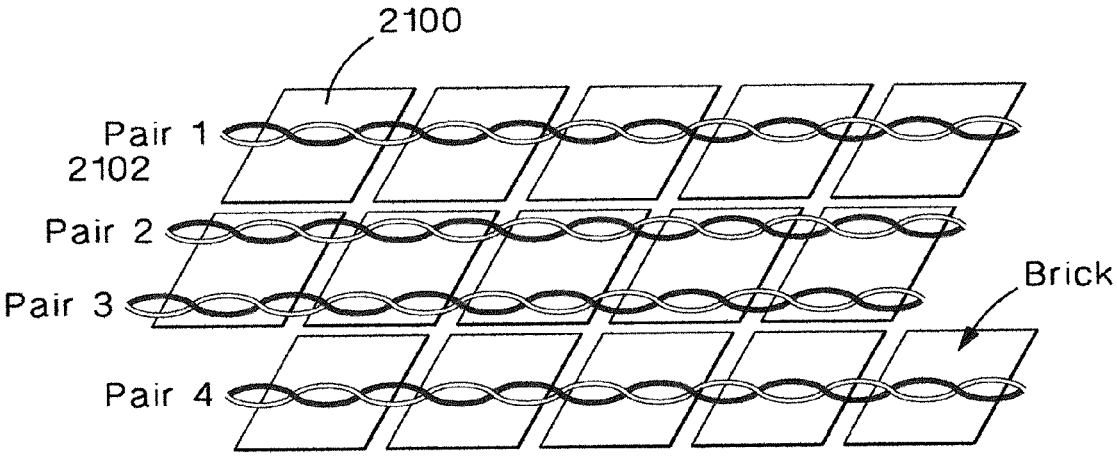
FIG. 27 is a schematic diagram illustrating a pattern of parallelogram bricks aligned with respective wire pairs.
Figure 28A:
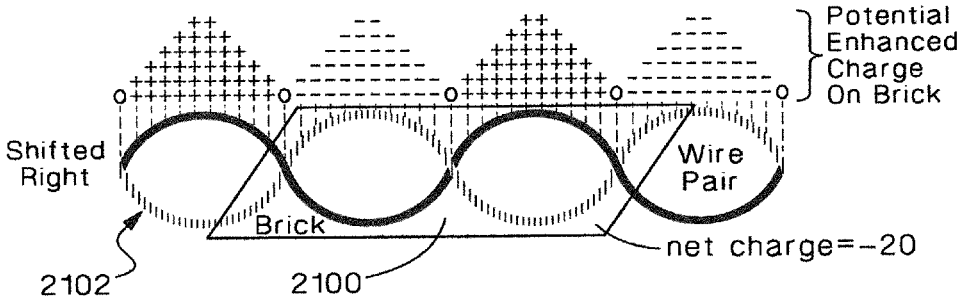
FIGS. 28A-C are conceptual diagrams illustrating charge variation that can occur if the shift of a position of a conductive element relative to the wire pair lay is on the order of plus or minus 10% of the wire pair lay length.
Figure 28B:
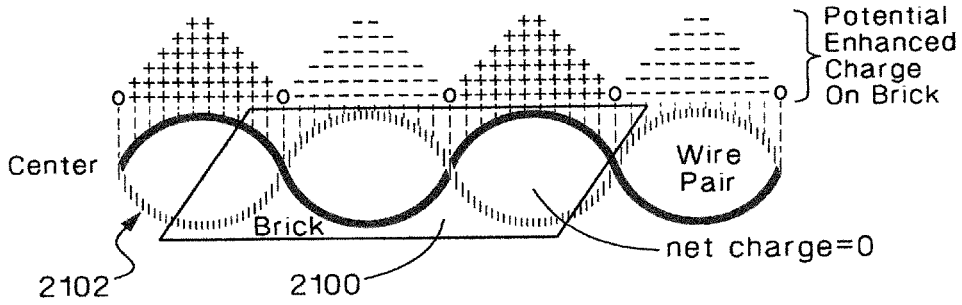
Figure 28C:
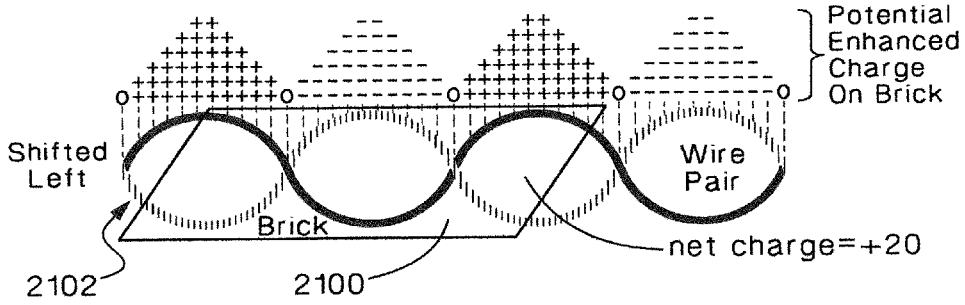

FIG. 27 shows such a pattern of non-regular parallelogram bricks 2100, aligned with respective wire pairs 2102. If the angle of the parallelogram is 20 degrees, then for a 60 mil change in wire pair position, the wire pair length is shifted by about 22 mils. This 22 mil shift represents about 5% of a typical wire pair's length, which helps to reduce the amplitude of the peak of coherent differential mode coupling and thereby increase its bandwidth (the peak is essentially reduced and the peak width tends to spread out). FIGS. 28A-C illustrate the charge variation that can occur if the shift of length is on the order of plus or minus 10% of the wire pair lay length. Increasing the angle of the parallelogram further increases this variation.

In summary, to avoid coherent differential mode coupling in cables utilizing matrix tape, one can use one or more of the following techniques: (1) select the pair lay length and the periodicity length of the fixed metallic shapes to result in an acceptable coherence length (using the principles set forth above); (2) introduce randomness or sufficient pseudo-randomness into the metallic shape pattern, individual metallic shape dimensions, or pair lay length, or (3) randomize the matrix tape strand lay with respect to the strand lay of the wire pairs. Other similar techniques may also be possible and may be encompassed by one or more embodiments of the present invention.

Improved Electro-Magnetic Compatibility (EMC) for a Communication Cable Having Matrix Tape If a cable's longitudinal impedance is too low, a common mode signal can propagate on the matrix tape's metallic shapes (bricks), potentially causing the cable to radiate and become susceptible to electro-magnetic radiation. To minimize the EMC susceptibility or radiation, the longitudinal impedance should be increased.

As will be described with reference to FIGS. 29A-C and 30A-C, the longitudinal impedance of a matrix tape-wrapped cable can be increased by choosing the pattern of metallic shapes on the matrix tape to be a regular pattern of non-regular parallelogram metallic shapes. This will, in turn, reduce the overlap capacitance (between two metallic shapes overlapping on opposite sides of the metallic shape) and the spiral wrap overlap capacitance (between two metallic shapes that are brought into an overlap configuration due to the matrix tape being wrapped around the cable core). The spiral wrap overlap capacitance (FIGS. 29A-B and 30A-B) will generally be the dominating component of the longitudinal impedance because it represents a capacitance that extends from one brick to another brick located a few bricks away longitudinally.

Figure 29A:
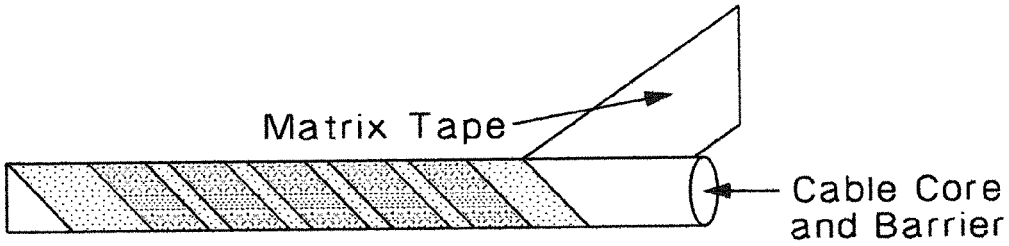
FIG. 29A is a perspective diagram of a rectangular-brick matrix tape wrapped around a cable core and barrier.
Figure 29B:
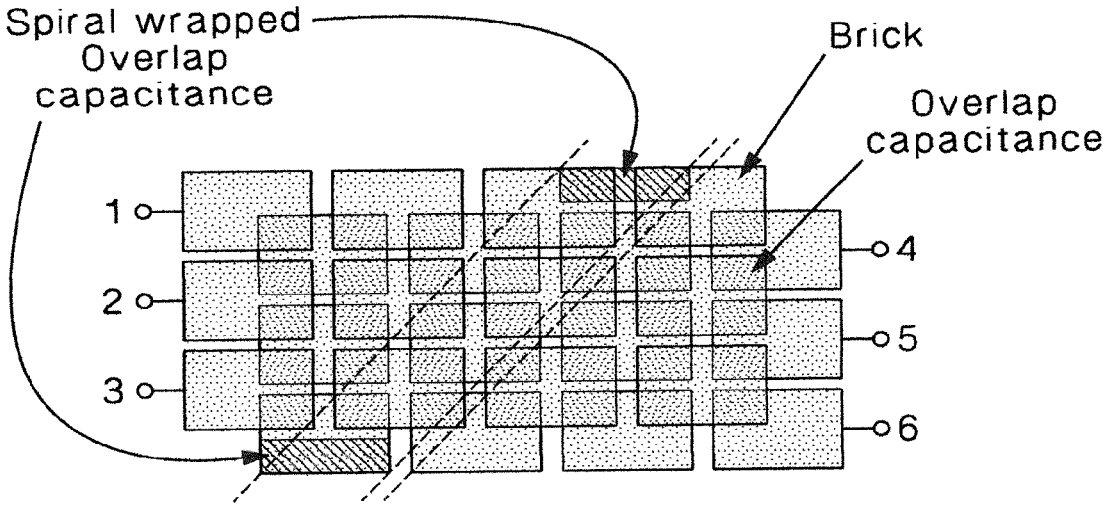
FIG. 29B is a conceptual diagram illustrating spiral-wrapped overlap capacitance and overlap capacitance for a rectangular-brick matrix tape wrapped around a cable core and barrier.
Figure 29C:
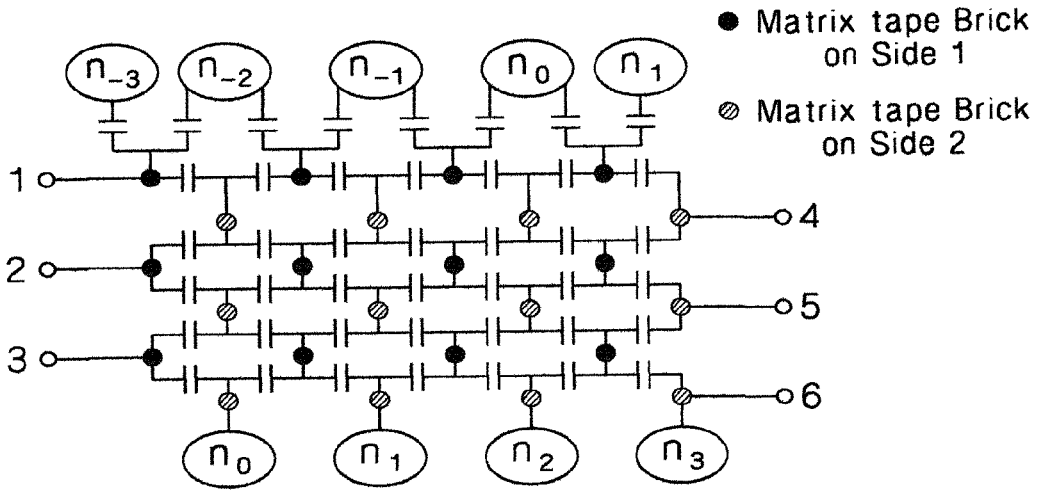
FIG. 29C is an equivalent circuit diagram of the configuration of FIG. 29B.
Figure 30A:
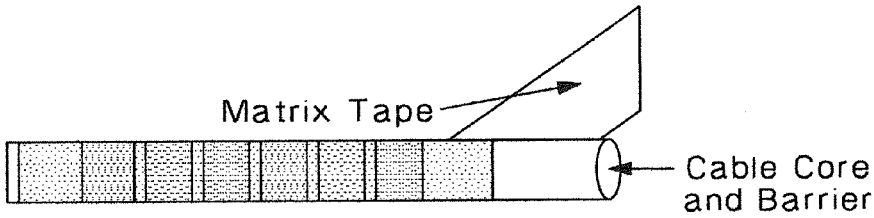
FIG. 30A is a perspective diagram of a rectangular-brick matrix tape wrapped around a cable core and barrier.
Figure 30B:
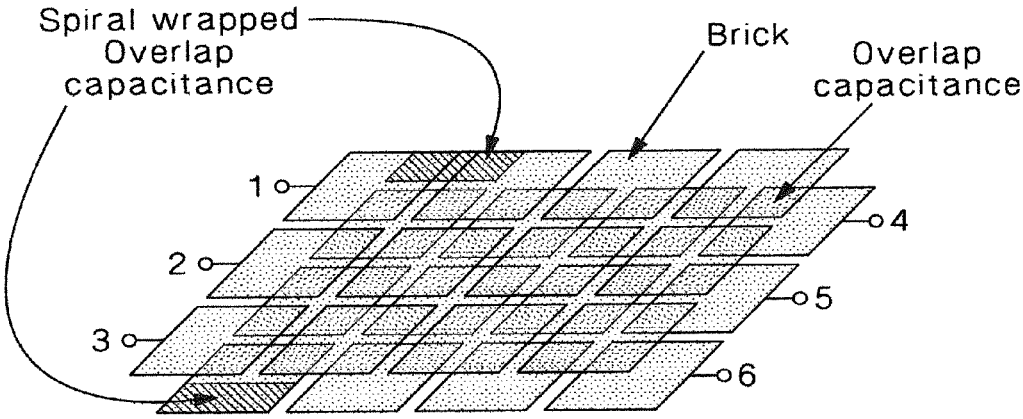
FIG. 30B is a conceptual diagram illustrating spiral-wrapped overlap capacitance and overlap capacitance for a non-regular parallelogram-brick matrix tape wrapped around a cable core and barrier.
Figure 30C:
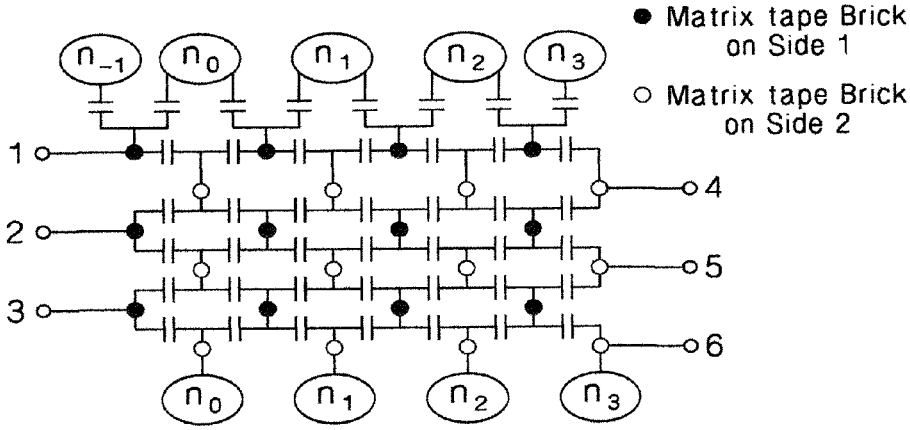
FIG. 30C is an equivalent circuit diagram of the configuration of FIG. 30B.

FIG. 29A-C illustrates the case in which regular parallelogram metallic shapes (i.e. rectangles) are used as the bricks, while FIG. 30A-C illustrates the case in which non-regular parallelogram metallic shapes (i.e. parallelogram) are used. As can be seen in the equivalent circuit diagrams of FIGS. 29C and 30C (in conjunction with FIGS. 29B and 30B), the spiral wrap overlap capacitance is essentially in parallel with a series string of capacitors. With the series string of capacitors, the total capacitance is reduced proportionally by the number of capacitors that are in series (hence shorter bricks leads to a higher desirable longitudinal impedance). When the spiral wrap overlap capacitance is placed in parallel, it increases the total capacitance, thereby reducing the longitudinal impedance. On the other hand, when a regular pattern of non-regular parallelograms is used (FIGS. 30A-C), the spiral wrap overlap capacitance is placed in parallel with a smaller number of the series string of capacitors, resulting in a decrease in the total capacitance and a corresponding increase in the longitudinal impedance. This will, in turn, result in less electro-magnetic radiation and susceptibility.

Improved Signal Attenuation Characteristics

The use of matrix tape provides an additional benefit: improved attenuation characteristics, resulting in an increased signal-to-noise ratio and other benefits that can be derived from this (e.g., channel data rate capacity). This improved attenuation spectra results from the re-orientation of the electromagnetic fields (corresponding to the new boundary conditions that the Matrix tape offers), which re-distributes the current density in the wire pairs. The re-distribution of the current density has an increased cross-sectional surface area which reduces the attenuation within the wire pairs.

Figure 31:
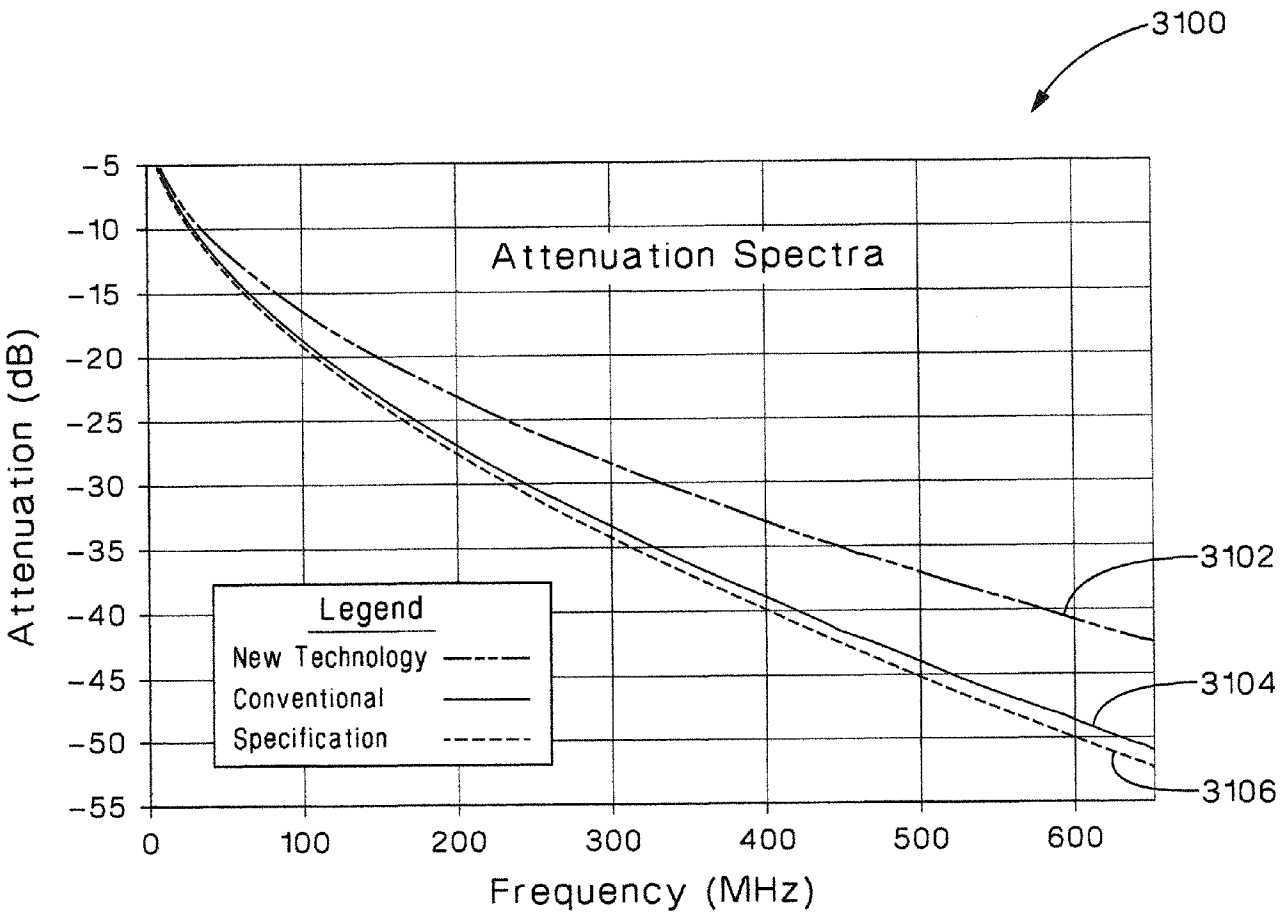
FIG. 31 is a chart describing the attenuation spectra of a U/UTP cable with and without matrix tape in relation to the TIA568 specification for attenuation, respectively.
Figure 32A:
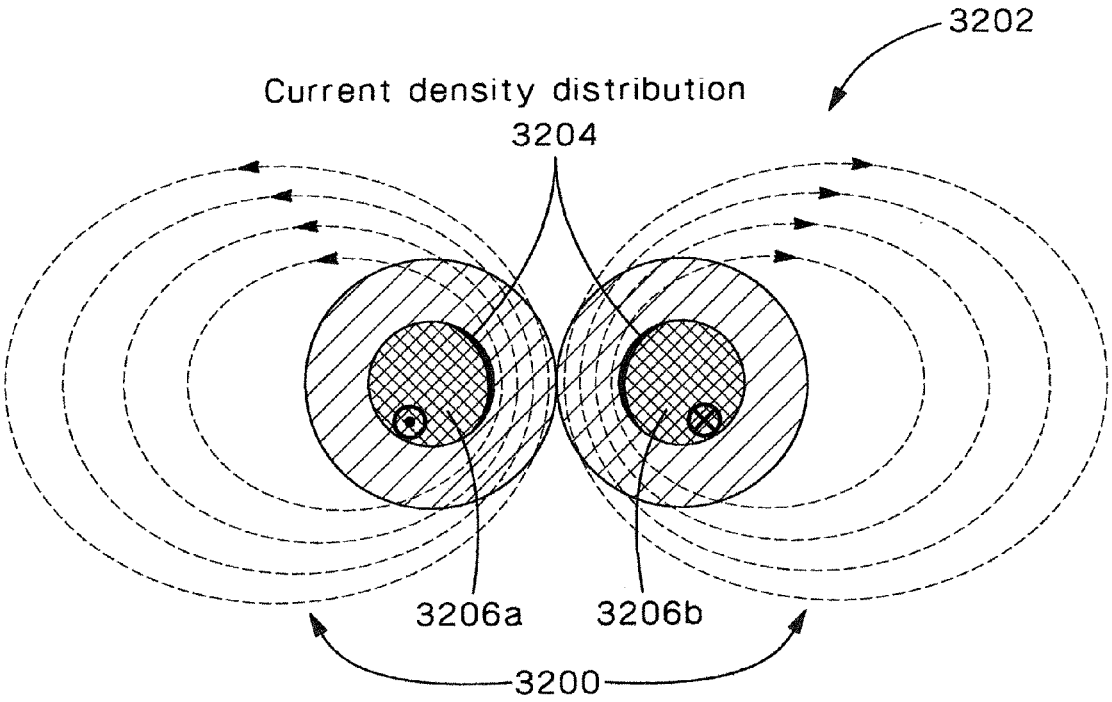
FIGS. 32A-B are conceptual diagrams illustrating magnetic fields surrounding U/UTP cables without and with matrix tape, respectively.
Figure 32B:
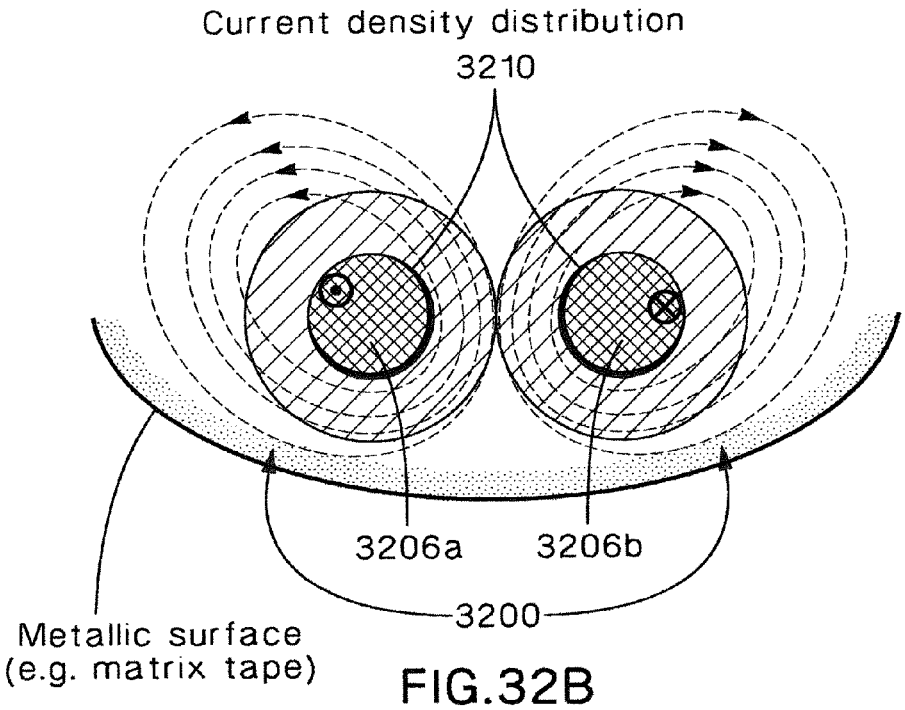

The signal level at the receive side of an Ethernet Network Equipment is largely controlled by the attenuation within the cable. There are two main contributors to loss within a cable. They are (1) conductive loss (conductor conductivity and loss related to the copper diameter and surface roughness) and (2) dielectric loss (related to the loss within the dielectric material that surrounds the copper wires). Placing matrix tape in close proximity to the wire pairs changes the electro-magnetic fields from being concentrated between the wires to being slightly more spread out (i.e., a higher density of the electric field will terminate onto the metallic shapes). This helps for three main reasons. First, it increases the cross sectional area for current density within the copper wire, which reduces the conductive loss. Second, it reduces the dielectric loss, as some of the field now can pass through lower loss dielectric media. Third, the matrix tape reduces the amount of electromagnetic field that reaches the dielectric of the outer jacket material that could otherwise contribute to dielectric loss. FIGS. 31 and 32A-B provide a conceptual illustration of these benefits. These figures will assume a 10 Gb/s cable with matrix tape, four pairs of copper wire (~25 mil diameter of copper) with a FR-loaded (fire retardant) polyethylene dielectric surrounding the copper (~46 mil diameter), a foamed polyethylene spacer separating the wire pairs (~15 mil wide by 155 mil long), a foamed polypropylene or polyethylene barrier between the wire pairs and matrix tape (~10 mils wide), and an outer poly-vinyl-chloride (PVC) jacket (~16 mils). (See, e.g., FIG. 13.)

The electromagnetic fields produced by the wire pairs penetrate the wire dielectric, the separator, the barrier and the matrix tape. The electromagnetic fields are highly reduced outside the matrix tape. Thus, the outer jacket and elements outside the cable only minimally affect the wire pairs' attenuation. FIG. 31 shows a chart 3100 describing the attenuation spectra of a U/UTP cable that employs the matrix tape 3102, a U/UTP cable that does not use the matrix tape 3104, and the TIA568 specification for attenuation 3106. Note the attenuation spectra improvement for a cable utilizing the matrix tape.

FIG. 32A is a conceptual illustration of the magnetic fields 3200 that surround a U/UTP cable 3202 that does not utilize the matrix tape. Note that the current density 3204 within the copper wire 3206*a-b* distributes itself according to these electromagnetic fields 3200. This resulting small cross sectional area distribution of current 3204 in the wire pair 3206*a-b* is concentrated between the wires and has a shallow depth of penetration into the wire pair. As shown in FIG. 32B, when a conductive surface (e.g., the matrix tape) is brought near to the wire pair 3206*a-b*, the fields 3208 re-distribute, causing a re-distribution of current 3210 within the copper wires 3206*a-b*. This re-distribution yields a larger cross sectional area for conduction and hence a smaller amount of attenuation. This mechanism accounts for the conductive portion of the attenuation reduction. Dielectric loss is also reduced due to this re-distribution of fields 3200, 3208 whereby the fields spread into portions of dielectric material within the cable that have lower dissipation factors. This reduction of the conductive and dielectric loss within the cable results in a higher performing 10 Gb/s Ethernet channel performance due to the improved signal-to-noise ratio.

Alternative Embossed-Film Used as an Inner Insulating Layer with a Matrix Tape

Figure 33:
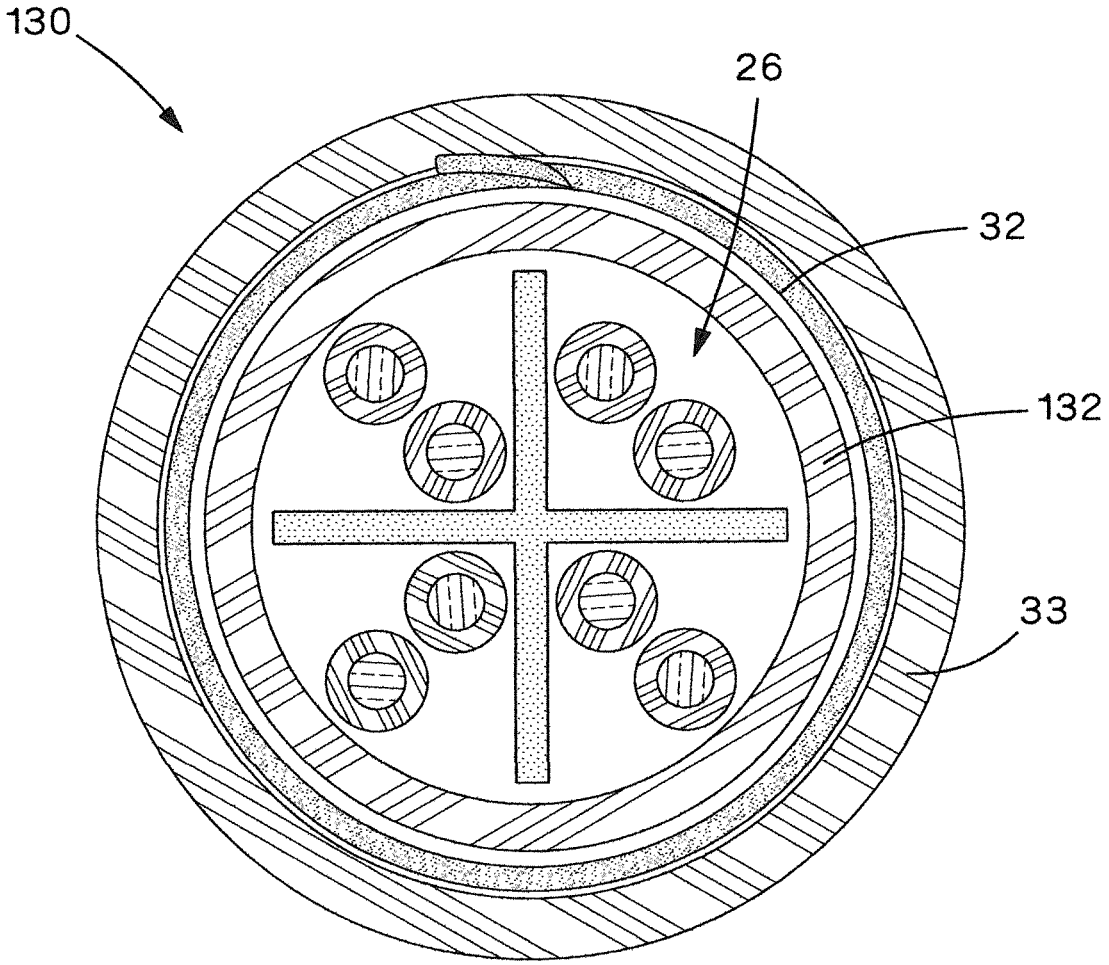
FIG. 33 is a cross-sectional view of a cable incorporating an embossed film as an insulating layer.

FIG. 33 is a cross-sectional view of another cable 130 having an embossed film 132 as the insulating layer between the twisted wire pairs 26 and the matrix tape 32. According to some embodiments, the embossed film 132 is in the form of an embossed tape made of a polymer such as polyethylene, polypropylene, or fluorinated ethylene propylene (FEP). In some embodiments, the embossed film 132 is made of an embossed layer of foamed polyethylene or polypropylene. Unfoamed fire-retardant polyethylene may be used as the base material. Embossing the film 132 provides for an insulating layer having a greater overall thickness than the thickness of the base material of the film. This produces a greater layer thickness per unit mass than non-embossed solid or foamed films. The incorporation of more air into the layer, via embossing, lowers the dielectric constant of the resulting layer, allowing for an overall lower cable diameter because the lower overall dielectric constant of the layer allows for a similar level of performance as a thicker layer of a material having a higher dielectric constant. The use of an embossed film reduces the overall cost of the cable by reducing the amount of solid material in the cable, and also improves the burn performance of the cable because a smaller amount of flammable material is provided within the cable than if a solid insulating layer is used. The use of an embossed film as the insulting layer has also been found to improve the insertion loss performance of the cable. Insulating layers according to the present invention may be spirally or otherwise wrapped around a cable core.

Figure 34:
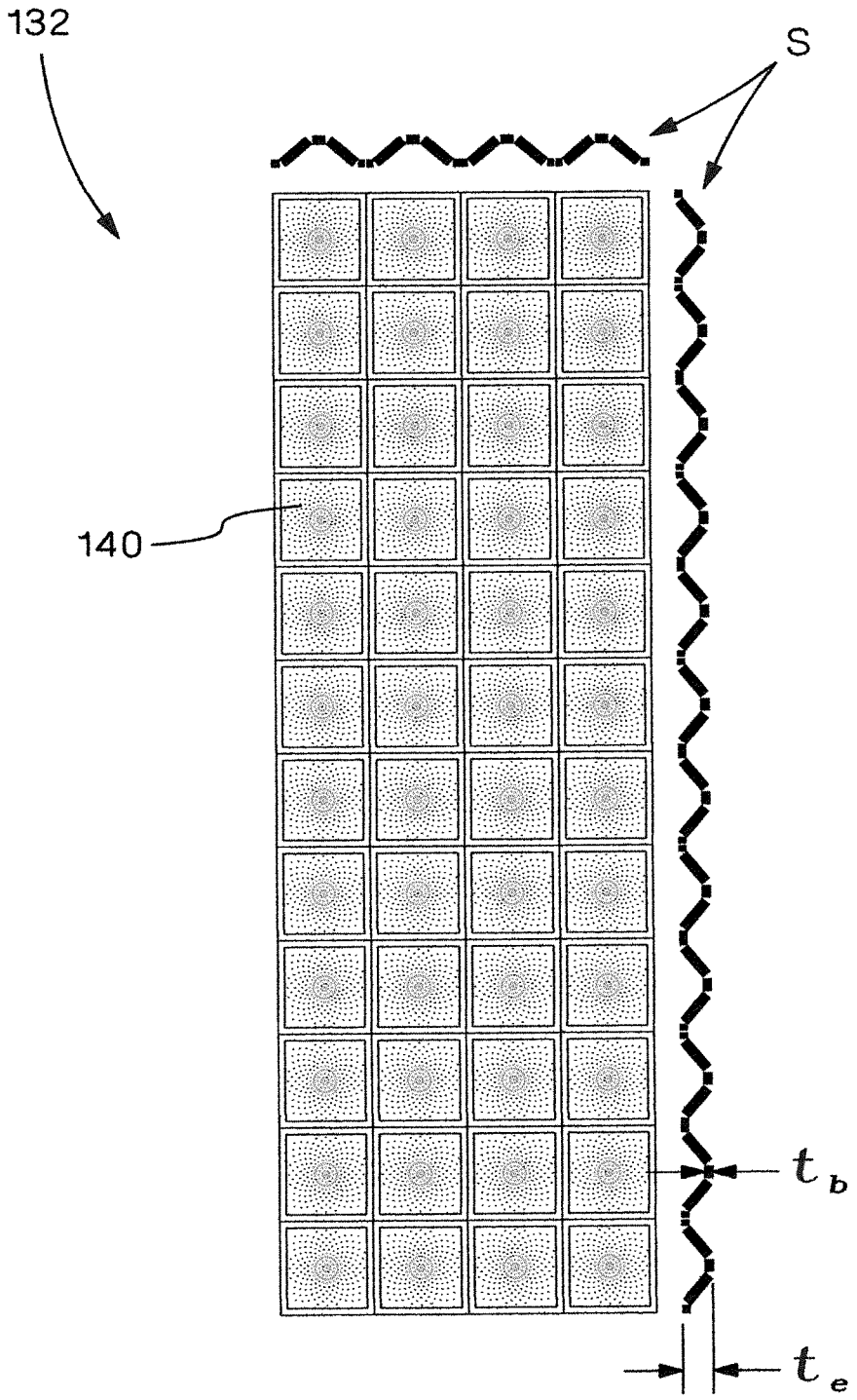
FIG. 34 is a plan view of an embossed film.

FIG. 34 is a plan view of one embodiment of an embossed film 132. Side detail views S are also shown in FIG. 34. In the embodiment shown in FIG. 34, the embossed film 132 takes the form of a repeating pattern of embossed squares 140 in a base material such as polyethylene or polypropylene, either foamed or unfoamed. In a preferred embodiment, a foamed polymer film material is used. The aspect ratio of the embossed film 132 is the ratio between the effective thickness of the embossed film, $t_e$, and the thickness of the base material, $t_b$. Aspect ratios of up to 5, for example with a base material thickness of 3 mils and an effective thickness of 15 mils for the embossed film, are used according to some embodiments. Other useful ratios include a base material thickness of 3 mils and an effective thickness of 14 mils; a base material thickness of 5 mils and an effective thickness of 15 mils. According to some embodiments, base materials in the range of from 1.5 to 7 mils are embossed to effective thicknesses of from 8 mils to 20 mils. While embossed squares 140 are shown in FIG. 34, other shapes may be used, as may a combination of different shapes over the length of the film 132, including the use of patterned embossing.

Figure 35A:
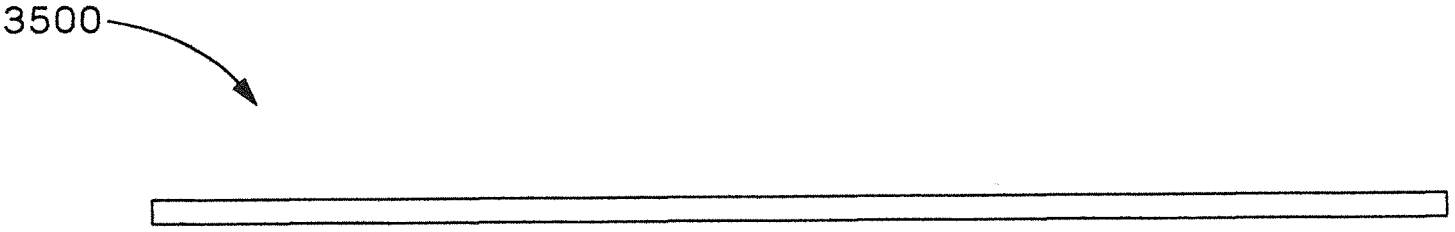
FIGS. 35A-B show side views of the construction of a perforated barrier layer.
Figure 35B:
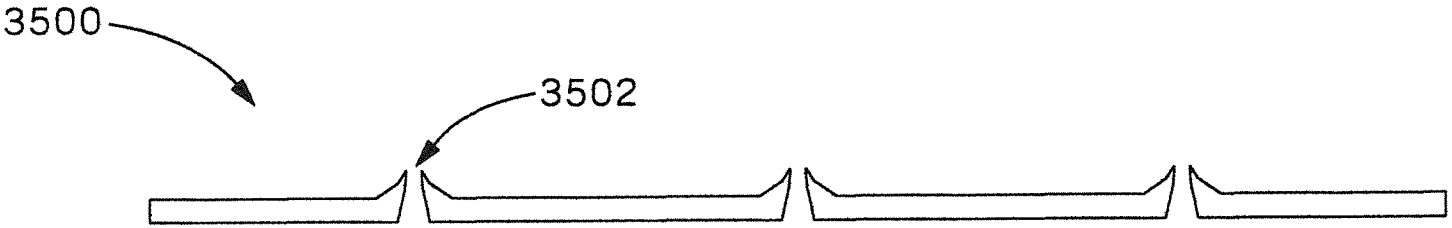

FIGS. 35-39 illustrate an alternative embodiment of a barrier layer, made of a perforated tape such as a perforated fluorinated ethylene propylene (FEP) or polytetrafluoroethylene (PTFE) film. In this embodiment, perforation or other deformation of a solid film increases the thickness of the film by displacing material beyond the plane of the film. FIG. 35 (*a*) is a side view of a layer of film 3500 without perforations, and FIG. 35 (*b*) shows the same film 3500 with perforations 3502, which increase the total effective thickness of the film. As a result of this perforation with deformation, the effective thickness of the film layer is increased in cable applications. This results in a greater barrier thickness per unit mass than solid tape. Also, using the film 3500 as a barrier layer places more air between the twisted pairs of a cable and a matrix tape, lowering the dielectric constant of the barrier layer and resulting in a lower required thickness of the barrier layer. Because the resulting overall dielectric constant of the barrier layer is lower, the cable can be manufactured with a smaller diameter. In addition, a reduction in the overall amount of material in the cable lowers the overall cost of the cable and improves the UL burn performance of the cable.

Example initial film thicknesses for use in cables according to the present invention are 0.0055" and 0.004", though, for example, thicknesses of from 0.002" to 0.020" may be used. Following perforation, the effective thickness of the film (that is, the distance from a "peak" of a perforation to the opposite layer of the film) increases by approximately a factor of two. This effective doubling of thickness is reduced somewhat during cable construction, as the perforated film is compressed. Greater or lesser increases in effective thickness may be achieved by using different perforation techniques.

Figure 36:
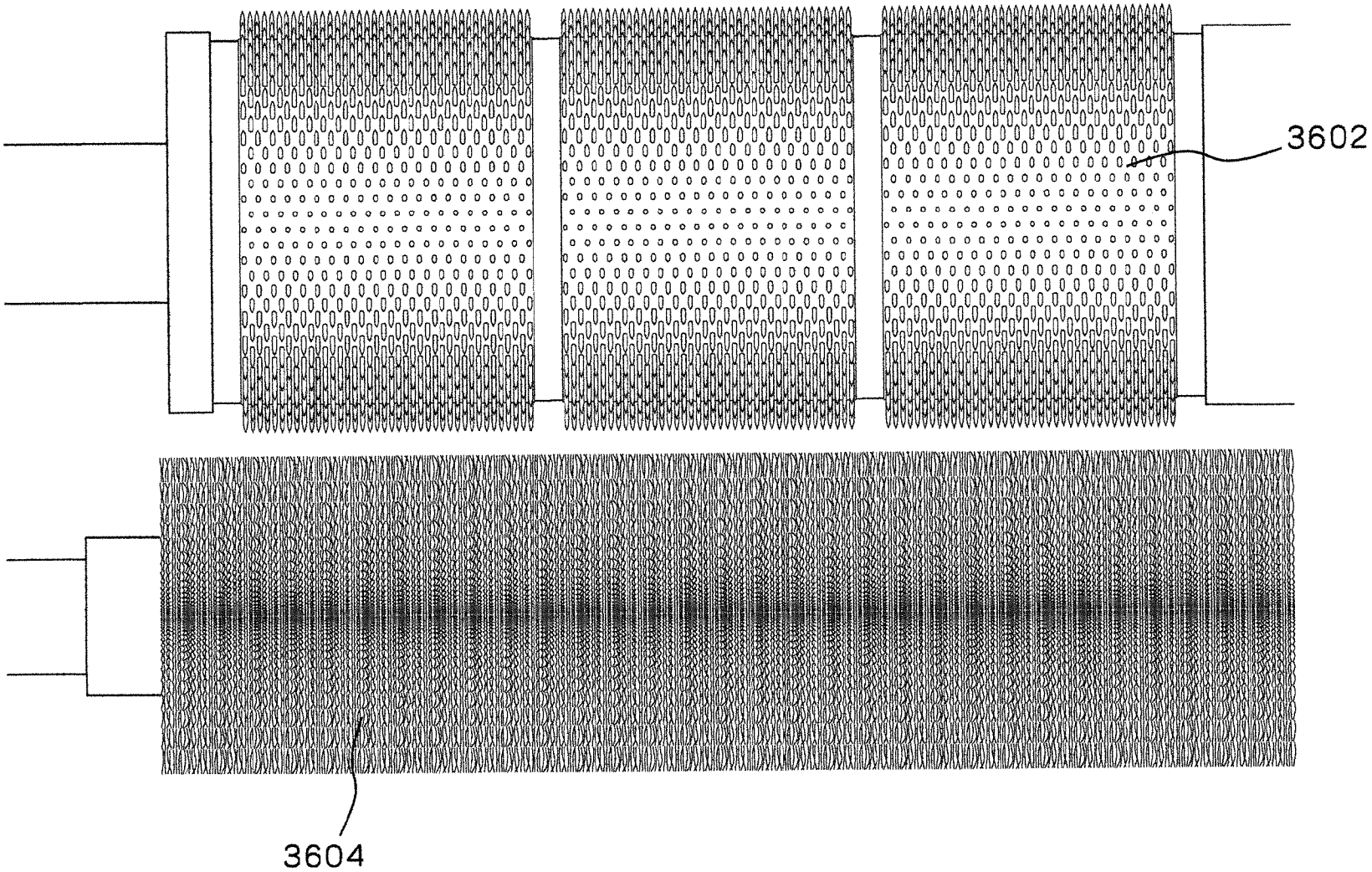
FIG. 36 shows a device for manufacturing a perforated barrier layer.

One method of manufacturing a perforated film according to the present invention is to use a heated "needle die" to puncture film. The heat used in this process aids in "setting" the resulting deformation of the material. FIG. 36 shows a rotating, heated needle die 3602 and an opposing roller brush 3604. During manufacture, the material to be perforated is fed between the rotating needle die 3602 and roller brush 3604.

Figure 37:
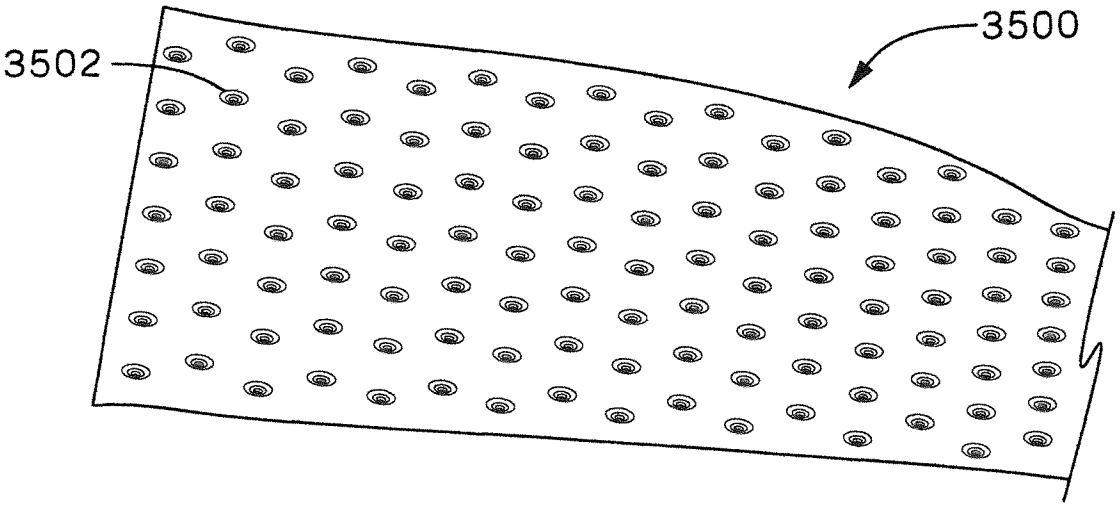
FIG. 37 is a perspective view of a perforated barrier layer.
Figure 38:
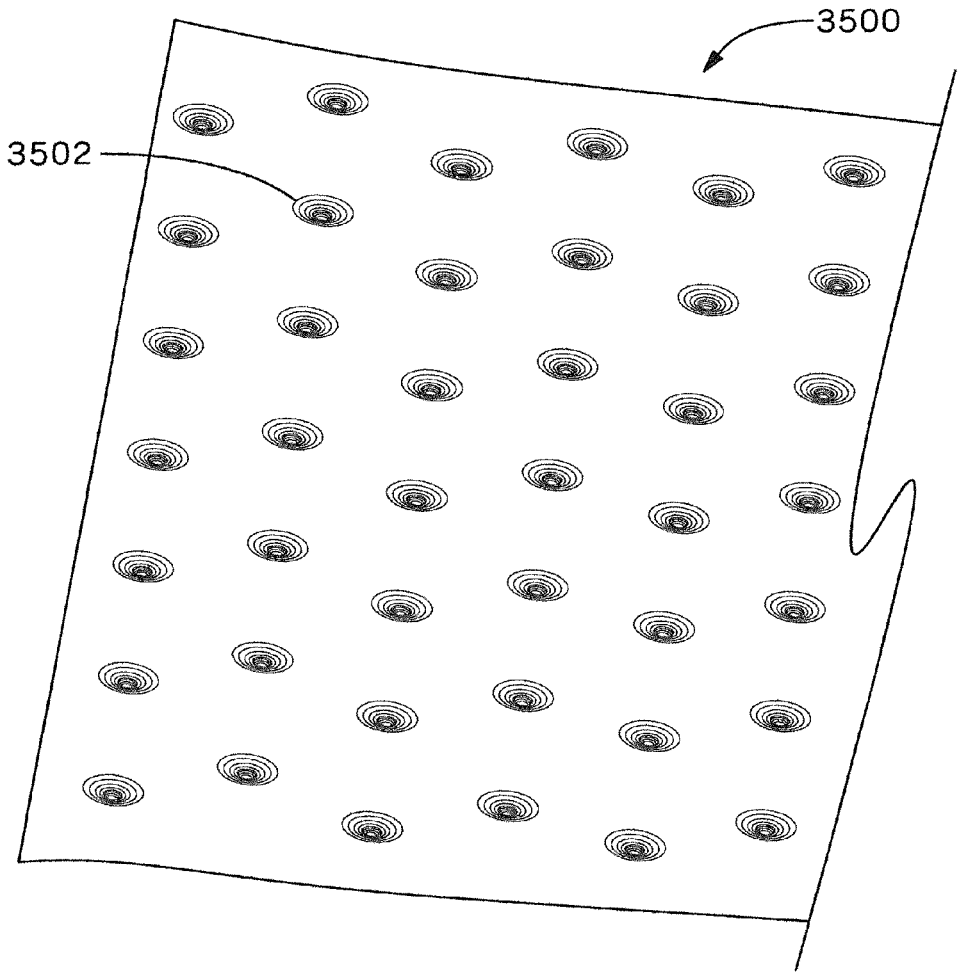
FIG. 38 is a perspective view of a perforated barrier layer.

FIGS. 37 and 38 show perspective views of perforated films 3500, having perforations 3502 that are provided with a permanent deformation set.

Figure 39:
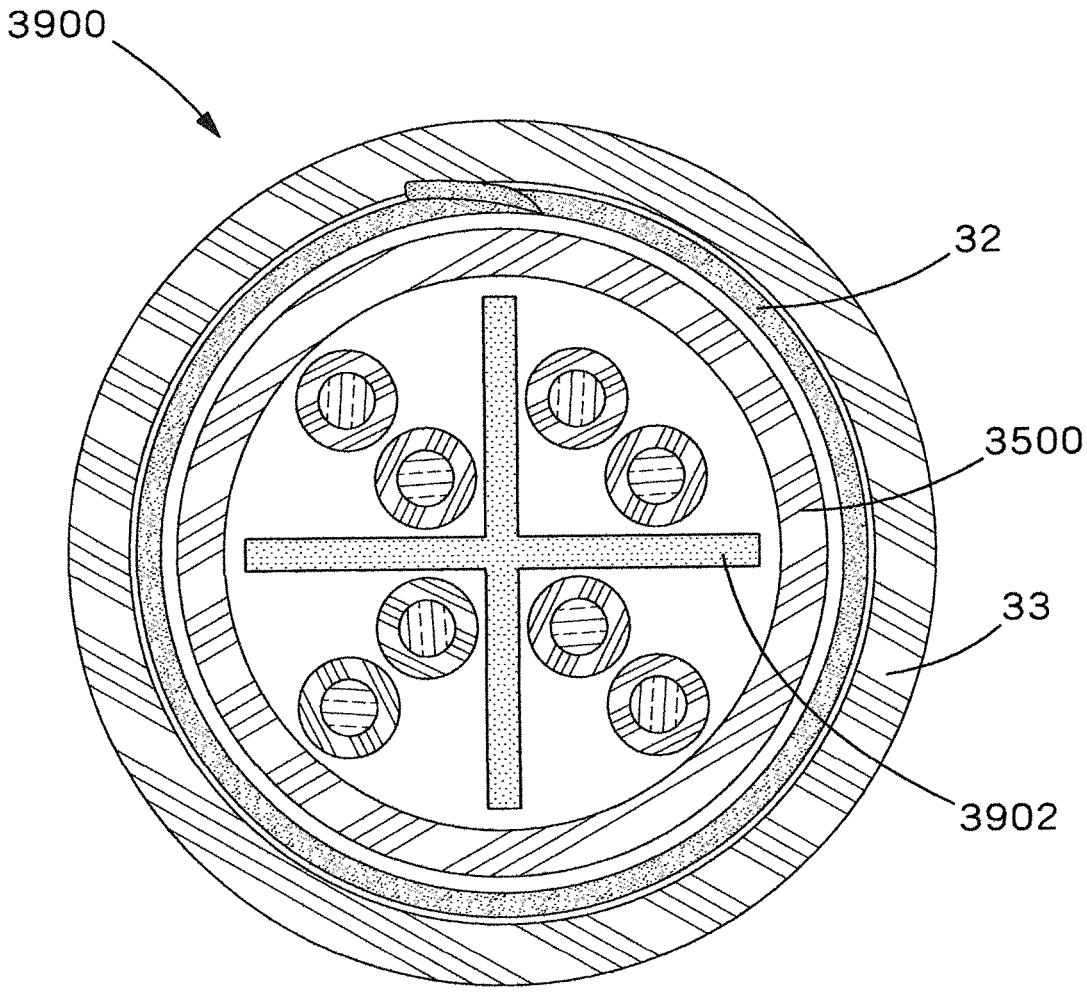
FIG. 39 is a cross-sectional view of a cable having a perforated barrier layer.

FIG. 39 shows a cross-section of a cable 3900 having a perforated film 3500 provided as a barrier layer between the cable core (which may include a separator 3902) and a layer of matrix tape 32. A jacket 33 surrounds the matrix tape 32.

Matrix tapes according to the present invention can be spirally, or otherwise, wrapped around individual twisted pairs within the cable to improve crosstalk attenuation between the twisted pairs. Further, barrier layers according to the present invention may be incorporated into different structures within a cable, including an insulating layer, an outer insulating jacket, or a twisted-pair divider structure.

From the foregoing, it can be seen that there have been provided features for improved performance of cables to increase attenuation of cable-to-cable crosstalk, while also improving other electro-magnetic characteristics. While particular embodiments of the present invention have been shown and described, it will be obvious to those skilled in the art that changes and modifications may be made without departing from the invention in its broader aspects. Therefore, the aim is to cover all such changes and modifications as fall within the true spirit and scope of the invention. The matter set forth in the foregoing description and accompanying drawings is offered by way of illustration only and not as a limitation.

The invention claimed is:

1. A communication cable comprising:

a cable core comprising a plurality of twisted pairs of conductors, said twisted pairs being twisted at pair lay lengths and carrying a communication signal in a range of frequencies, each of said frequencies having a corresponding wavelength; and a matrix tape surrounding said inner insulating layer, said matrix tape comprising a first barrier layer of conductive segments separated by gaps, longitudinal lengths of said conductive segments being greater than the longest of said twisted pair lay lengths, smaller than one fourth of the wavelength of the highest-frequency signal transmitted over said twisted pairs of conductors, and not an integer or half-integer multiple of any of the twisted pair lay lengths of the twisted pairs of conductors.

2. The communication cable of claim 1 further comprising a crossweb separating said twisted pairs of conductors.

3. The communication cable of claim 1 further comprising an outer insulating jacket.

4. The communication cable of claim 1 wherein said matrix tape is helically wrapped around said inner insulating layer.

5. The communication cable of claim 1, wherein said matrix tape further comprises a second barrier layer of conductive segments separated by gaps, said conductive segments being provided in a pattern such that the conductive segments of the second barrier generally are aligned with the gaps of the first barrier layer.

6. The communication cable of claim 1 wherein said conductive segments have transverse widths wide enough to overlie one of said twisted pairs in a radial direction.

7. The communication cable of claim 1 further comprising an inner insulation layer separating said cable core and said matrix tape.

8. The communication cable of claim 1 further comprising an embossed film between said cable core and said matrix tape.

9. The communication cable of claim 8 wherein said embossed film comprises an embossed foamed film.

10. The communication cable of claim 1 further comprising a perforated tape between said cable core and said matrix tape.

11. A communication cable comprising:

a cable core comprising a plurality of twisted pairs of conductors, said twisted pairs being twisted at pair lay lengths and carrying a communication signal in a range of frequencies, each of said frequencies having a corresponding wavelength;

an embossed film around said cable core; and a matrix tape surrounding said inner insulating layer, said matrix tape comprising first and second barrier layers, each of said barrier layers comprising conductive segments separated by gaps, wherein longitudinal lengths of said conductive segments are greater than the longest of said twisted pair lay lengths, smaller than one fourth of the wavelength of the highest-frequency signal transmitted over said twisted pairs of conductors, and not an integer or half-integer multiple of any of the twisted pair lay lengths of the twisted pairs of conductors.

12. The communication cable of claim 11 further comprising a crossweb separating said twisted pairs of conductors.

13. The communication cable of claim 11 wherein said matrix tape is helically wrapped around said inner insulating layer.

14. The communication cable of claim 11 wherein said conductive segments are provided in a pattern such that the conductive segments of the second barrier generally are aligned with the gaps of the first barrier layer.

* * * * *